US007970150B2

(12) United States Patent
Oxford

(10) Patent No.: US 7,970,150 B2
(45) Date of Patent: Jun. 28, 2011

(54) TRACKING TALKERS USING VIRTUAL BROADSIDE SCAN AND DIRECTED BEAMS

(75) Inventor: William V. Oxford, Austin, TX (US)

(73) Assignee: LifeSize Communications, Inc., Austin, TX (US)

( * ) Notice: Subject to any disclaimer, the term of this patent is extended or adjusted under 35 U.S.C. 154(b) by 1304 days.

(21) Appl. No.: 11/402,197

(22) Filed: Apr. 11, 2006

(65) Prior Publication Data

US 2006/0256974 A1 Nov. 16, 2006

Related U.S. Application Data

(60) Provisional application No. 60/676,415, filed on Apr. 29, 2005.

(51) Int. Cl.
*H04R 3/00* (2006.01)

(52) U.S. Cl. ..... 381/92; 381/94.1; 381/94.3; 381/122

(58) Field of Classification Search ..... 381/92, 381/94.1, 94.3, 122; 367/118, 124, 127, 367/129

See application file for complete search history.

(56) References Cited

U.S. PATENT DOCUMENTS

| | | | |
|---|---|---|---|
| 3,963,868 | A | 6/1976 | Randmere et al. |
| 4,536,887 | A | 8/1985 | Kaneda et al. |
| 4,802,227 | A | 1/1989 | Elko et al. |
| 4,903,247 | A | 2/1990 | Van Gerwen et al. |
| 5,029,162 | A | 7/1991 | Epps |
| 5,034,947 | A | 7/1991 | Epps |
| 5,051,799 | A | 9/1991 | Paul et al. |
| 5,054,021 | A | 10/1991 | Epps |
| 5,121,426 | A | 6/1992 | Baumhauer, Jr. et al. |
| 5,168,525 | A | 12/1992 | Muller |
| 5,263,019 | A | 11/1993 | Chu |

(Continued)

FOREIGN PATENT DOCUMENTS

JP 62203432 9/1987

(Continued)

OTHER PUBLICATIONS

"A history of video conferencing (VC) technology" http://web.archive.org/web/20030622161425/http://myhome.hanafos.com/~soonjp/vchx.html (web archive dated Jun. 22, 2003); 5 pages.

(Continued)

*Primary Examiner* — Vivian Chin
*Assistant Examiner* — Paul Kim
(74) *Attorney, Agent, or Firm* — Meyertons Hood Kivlin Kowert & Goetzel, P.C.; Jeffrey C. Hood; Mark K. Brightwell

(57) ABSTRACT

A communication system (e.g., a speakerphone) includes an array of microphones, a speaker, memory and a processor. The processor may be configured to perform acoustic echo cancellation, to track multiple talkers with highly directed beams, to design beams with nulls pointed at noise sources, to generate a 3D model of the physical environment, to compensate for the proximity effect, and to perform dereverberation of a talker's voice signal. The processor may also be configured to use a standard codec in non-standard ways. The processor may perform a virtual broadside scan on the microphone array, analyze the resulting amplitude envelope for acoustic source angles, examine each of the source angles with a directed beam, combine the beam outputs that show the characteristics of intelligence or speech.

18 Claims, 25 Drawing Sheets

U.S. PATENT DOCUMENTS 5,305,307 A 4/1994 Chu
5,335,011 A 8/1994 Addeo et al.
5,365,583 A 11/1994 Huang et al.
5,390,244 A 2/1995 Hinman et al.
5,396,554 A 3/1995 Hirano et al.
5,550,924 A 8/1996 Helf et al.
5,566,167 A 10/1996 Duttweiler
5,581,620 A 12/1996 Brandstein et al.
5,606,642 A 2/1997 Stautner et al.
5,617,539 A 4/1997 Ludwig et al.
5,649,055 A 7/1997 Gupta et al.
5,657,393 A 8/1997 Crow
5,664,021 A 9/1997 Chu et al.
5,689,641 A 11/1997 Ludwig et al.
5,715,319 A * 2/1998 Chu ..... 381/26
5,737,431 A 4/1998 Brandstein et al.
5,742,693 A 4/1998 Elko
5,751,338 A 5/1998 Ludwig, Jr.
5,778,082 A 7/1998 Chu et al.
5,787,183 A 7/1998 Chu et al.
5,793,875 A 8/1998 Lehr et al.
5,825,897 A 10/1998 Andrea et al.
5,844,994 A 12/1998 Graumann
5,896,461 A 4/1999 Faraci et al.
5,924,064 A 7/1999 Helf
5,983,192 A 11/1999 Botzko et al.
6,041,127 A 3/2000 Elko
6,049,607 A 4/2000 Marash et al.
6,072,522 A 6/2000 Ippolito et al.
6,130,949 A 10/2000 Aoki et al.
6,141,597 A 10/2000 Botzko et al.
6,173,059 B1 1/2001 Huang et al.
6,198,693 B1 3/2001 Marash
6,243,129 B1 6/2001 Deierling
6,246,345 B1 6/2001 Davidson et al.
6,317,501 B1 11/2001 Matsuo
6,351,238 B1 2/2002 Kishigami et al.
6,351,731 B1 2/2002 Anderson et al.
6,363,338 B1 3/2002 Ubale et al.
6,453,285 B1 9/2002 Anderson et al.
6,459,942 B1 10/2002 Markow et al.
6,469,732 B1 10/2002 Chang et al.
6,526,147 B1 2/2003 Rung
6,535,604 B1 3/2003 Provencal et al.
6,535,610 B1 3/2003 Stewart
6,566,960 B1 5/2003 Carver
6,584,203 B2 6/2003 Elko et al.
6,587,823 B1 7/2003 Kang et al.
6,590,604 B1 7/2003 Tucker et al.
6,593,956 B1 7/2003 Potts et al.
6,594,688 B2 7/2003 Ludwig et al.
6,615,236 B2 9/2003 Donovan et al.
6,625,271 B1 9/2003 O'Malley et al.
6,646,997 B1 11/2003 Baxley et al.
6,657,975 B1 12/2003 Baxley et al.
6,697,476 B1 2/2004 O'Malley et al.
6,721,411 B2 4/2004 O'Malley et al.
6,731,334 B1 5/2004 Maeng et al.
6,744,887 B1 6/2004 Berstein et al.
6,760,415 B2 7/2004 Beecroft
6,816,904 B1 11/2004 Ludwig et al.
6,822,507 B2 11/2004 Buchele
6,831,675 B2 12/2004 Shachar et al.
6,850,265 B1 2/2005 Strubbe et al.
6,856,689 B2 2/2005 Sudo et al.
6,912,178 B2 6/2005 Chu et al.
6,980,485 B2 12/2005 McCaskill
7,012,630 B2 3/2006 Curry et al.
7,130,428 B2 10/2006 Hirai et al.
7,133,062 B2 11/2006 Castles et al.
2002/0123895 A1 9/2002 Potekhin et al.
2003/0197316 A1 10/2003 Baumhauer, Jr. et al.
2004/0001137 A1 1/2004 Cutler et al.
2004/0010549 A1 1/2004 Matus et al.
2004/0032487 A1 2/2004 Chu et al.
2004/0032796 A1 2/2004 Chu et al.
2004/0183897 A1 9/2004 Kenoyer et al.
2005/0157866 A1 7/2005 Marton et al.
2005/0169459 A1 8/2005 Marton et al.
2005/0212908 A1 9/2005 Rodman et al.
2005/0262201 A1 11/2005 Rudolph et al.
2006/0013416 A1 1/2006 Truong et al.
2006/0034469 A1 2/2006 Tamiya et al.
2006/0109998 A1 5/2006 Michel
2006/0165242 A1 7/2006 Miki et al.

FOREIGN PATENT DOCUMENTS

JP 07264102 3/1994
JP 07135478 5/1995
JP 07240722 9/1995
JP 09307651 11/1997
JP 10190848 7/1998
WO PCT/US97/17770 4/1998
WO 9922460 5/1999
WO 2005064908 7/2005

OTHER PUBLICATIONS

"MediaMax Operations Manual"; May 1992; 342 pages; VideoTelecom; Austin, TX.

"MultiMax Operations Manual"; Nov. 1992; 135 pages; VideoTelecom; Austin, TX.

Ross Cutler, Yong Rui, Anoop Gupta, JJ Cadiz, Ivan Tashev, Li-Wei He, Alex Colburn, Zhengyou Zhang, Zicheng Liu and Steve Silverberg; "Distributed Meetings: A Meeting Capture and Broadcasting System"; Multimedia '02; Dec. 2002; 10 pages; Microsoft Research; Redmond, WA.

P. H. Down; "Introduction to Videoconferencing"; http://www.video.ja.net/intro/; 2001; 26 pages.

"Polycom Executive Collection"; Jun. 2003; 4 pages; Polycom, Inc.; Pleasanton, CA.

"MacSpeech Certifies Voice Tracker™ Array Microphone"; Apr. 20, 2005; 2 pages; MacSpeech Press.

"The Wainhouse Research Bulletin"; Apr. 12, 2006; 6 pages; vol. 7, #14.

"VCON Videoconferencing"; http://web.archive.org/web/20041012125813/http://www.itc.virginia.edu/netsys/videoconf/midlevel.html; 2004; 6 pages.

M. Berger and F. Grenez; "Performance Comparison of Adaptive Algorithms for Acoustic Echo Cancellation"; European Signal Processing Conference, Signal Processing V: Theories and Applications, 1990; pp. 2003-2006.

C.L. Dolph; "A current distribution for broadside arrays which optimizes the relationship between beam width and side-lobe level". Proceedings of the I.R.E. and Wave and Electrons; Jun. 1946; pp. 335-348; vol. 34.

M. Mohan Sondhi, Dennis R. Morgan and Joseph L. Hall; "Stereophonic Acoustic Echo Cancellation—An Overview of the Fundamental Problem"; IEEE Signal Processing Letters; Aug. 1995; pp. 148-151; vol. 2, No. 8.

Rudi Frenzel and Marcus E. Hennecke; "Using Prewhitening and Stepsize Control to Improve the Performance of the LMS Algorithm for Acoustic Echo Compensation"; IEEE International Symposium on Circuits and Systems; 1992; pp. 1930-1932.

Steven L. Gay and Richard J. Mammone; "Fast converging subband acoustic echo cancellation using RAP on the WE DSP16A"; International Conference on Acoustics, Speech, and Signal Processing; Apr. 1990; pp. 1141-1144.

Andre Gilloire and Martin Vetterli; "Adaptive Filtering in Subbands with Critical Sampling: Analysis, Experiments, and Application to Acoustic Echo Cancellation"; IEEE Transactions on Signal Processing, Aug. 1992; pp. 1862-1875; vol. 40, No. 8.

Andre Gilloire; "Experiments with Sub-band Acoustic Echo Cancellers for Teleconferencing"; IEEE International Conference on Acoustics, Speech, and Signal Processing; Apr. 1987; pp. 2141-2144; vol. 12.

Henry Cox, Robert M. Zeskind and Theo Kooij; "Practical Supergain", IEEE Transactions on Acoustics, Speech, and Signal Processing; Jun. 1986; pp. 393-398.

Walter Kellermann; "Analysis and design of multirate systems for cancellation of acoustical echoes"; International Conference on Acoustics, Speech, and Signal Processing, 1988 pp. 2570-2573; vol. 5.

Lloyd Griffiths and Charles W. Jim; "An Alternative Approach to Linearly Constrained Adaptive Beamforming"; IEEE Transactions on Antennas and Propagation; Jan. 1982; pp. 27-34; vol. AP-30, No. 1.
B. K. Lau and Y. H. Leung; "A Dolph-Chebyshev Approach to the Synthesis of Array Patterns for Uniform Circular Arrays" International Symposium on Circuits and Systems; May 2000; 124-127; vol. 1.
C. M. Tan, P. Fletcher, M. A. Beach, A. R. Nix, M. Landmann and R. S. Thoma; "On the Application of Circular Arrays in Direction Finding Part I: Investigation into the estimation algorithms", 1st Annual COST 273 Workshop, May/Jun. 2002; 8 pages.
Ivan Tashev; Microsoft Array project in MSR: approach and results, http://research.microsoft.com/users/ivantash/Documents/MicArraysInMSR.pdf; Jun. 2004; 49 pages.
Hiroshi Yasukawa, Isao Furukawa and Yasuzou Ishiyama; "Acoustic Echo Control for High Quality Audio Teleconferencing"; International Conference on Acoustics, Speech, and Signal Processing; May 1989; pp. 2041-2044; vol. 3.
Hiroshi Yasukawa and Shoji Shimada; "An Acoustic Echo Canceller Using Subband Sampling and Decorrelation Methods"; IEEE Transactions On Signal Processing; Feb. 1993; pp. 926-930; vol. 41, Issue 2.
"Press Releases"; Retrieved from the Internet: http://www.acousticmagic.com/press/; Mar. 14, 2003-Jun. 12, 2006; 18 pages; Acoustic Magic.
Marc Gayer, Markus Lohwasser and Manfred Lutzky; "Implementing MPEG Advanced Audio Coding and Layer-3 encoders on 32-bit and 16-bit fixed-point processors"; Jun. 25, 2004; 7 pages; Revision 1.11; Fraunhofer Institute for Integrated Circuits IIS; Erlangen, Germany.
Man Mohan Sondhi and Dennis R. Morgan; "Acoustic Echo Cancellation for Stereophonic Teleconferencing"; May 9, 1991; 2 pages; AT&T Bell Laboratories, Murray Hill, NJ.
Zhao, et al., "Closely Coupled Array Processing and Model-Based Compensation for Microphone Array Speech Recognition", IEEE International Conference on Acoustics, Speech, and Signal Processing 2005, Mar. 18-23, 2005, vol. 1, pp. 417-420.
Shin, et al., "Voice Activity Detection Based on Generalized Gamma Distribution", IEEE International Conference on Acoustics, Speech, and Signal Processing 2005, Mar. 18-23, 2005, 4 pages.
Busso, et al., "Smart Room: Participant and Speaker Localization and Identification", IEEE International Conference on Acoustics, Speech, and Signal Processing 2005, Mar. 18-23, 2005, vol. 2, pp. ii/1117-ii/1120.
Davis, et al., "A Subband Space Constrained Beamformer Incorporating Voice Activity Detection", IEEE International Conference on Acoustics, Speech, and Signal Processing 2005, Mar. 18-23, 2005, vol. 3, Philadelphia, PA, pp. iii/65-iii68.
Buchner, et al., "Simultaneous Localization of Multiple Sound Sources Using Blind Adaptive MIMO Filtering", IEEE International Conference on Acoustics, Speech, and Signal Processing 2005, Mar. 18-23, 2005, vol. 3, pp. iii/97-iii100.
Tashev, et al., "A New Beamformer Design Algorithm for Microphone Arrays", IEEE International Conference on Acoustics, Speech, and Signal Processing 2005, Mar. 18-23, 2005, vol. 3, Philadelphia, PA, pp. iii/101-iii/104.
Sawada, et al., "Blind Extraction of a Dominant Source Signal from Mixtures of Many Sources", IEEE International Conference on Acoustics, Speech, and Signal Processing 2005, Mar. 18-23, 2005, vol. 3, Philadelphia, PA, pp. iii/61-iii/64.
Rui, et al., "Sound Source Localization for Circular Arrays of Directional Microphones", IEEE International Conference on Acoustics, Speech, and Signal Processing 2005, Mar. 18-23, 2005, vol. 3, pp. iii/93-iii/96.
Lathoud, et al., "A Sector-Based, Frequency-Domain Approach to Detection and Localization of Multiple Speakers", IEEE International Conference on Acoustics, Speech, and Signal Processing 2005, Mar. 18-23, 2005, vol. 3, pp. iii/265-iii/268.
Abu-El-Quran, et al., "Adaptive Pitch-Based Speech Detection for Hands-Free Applications", IEEE International Conference on Acoustics, Speech, and Signal Processing 2005, Mar. 18-23, 2005, vol. 3, pp. iii/305-iii/308.
Bell, Kristine L., "MAP-PF Position Tracking with a Network of Sensor Arrays", IEEE International Conference on Acoustics, Speech, and Signal Processing 2005, Mar. 18-23, 2005, vol. 4, Philadelphia, PA, pp. iv/849-iv/852.
Belloni, et al., "Reducing Bias in Beamspace Methods for Uniform Circular Array", IEEE International Conference on Acoustics, Speech, and Signal Processing 2005, Mar. 18-23, 2005, vol. 4, Philadelphia, PA, pp. iv/973-iv/976.
Lau, et al., "Data-Adaptive Array Interpolation for DOA Estimation in Correlated Signal Environments", IEEE International Conference on Acoustics, Speech, and Signal Processing 2005, Mar. 18-23, 2005, vol. 4, Philadelphia, PA, pp. iv/945-iv/948.
Vo, et al., "Localizing an Unknown Time-Varying Number of Speakers: A Bayesian Random Finite Set Approach", IEEE International Conference on Acoustics, Speech, and Signal Processing 2005, Mar. 18-23, 2005, vol. 4, pp. iv-1073-iv/1076.
Antonacci, et al., "Efficient Source Localization and Tracking in Reverberant Environments Using Microphone Arrays", IEEE International Conference on Acoustics, Speech, and Signal Processing 2005, Mar. 18-23, 2005, vol. 4, pp. iv/1061-iv/1064.
Lau, et al, "Optimum Beamformers for Uniform Circular Arrays in a Correlated Signal Environment", IEEE International Conference on Acoustics, Speech, and Signal Processing 2000, vol. 5, pp. 3093-3096.
Tseng, et al., "A Simple Algorithm to Achieve Desired Patterns for Arbitrary Arrays", IEEE Transactions on Signal Processing 1992, vol. 40, No. 11, Nov. 1992, pp. 2737-2746.
Chu, Peter L., "Superdirective Microphone Array for a Set-Top Videoconferencing System", IEEE ASSP Workshop on applications of Signal Processing to Audio and Acoustics 1997, Oct. 19-22, 1997, 4 pages.
De Abreu, et al., "A Modified Dolph-Chebyshev Approach for the Synthesis of Low Sidelobe Beampatterns with Adjustable Beamwidth", IEEE Transactions on Antennas and Propagation 2003, vol. 51, No. 10, Oct. 2003, pp. 3014-3017.
Lau, Buon Kiong, "Applications of Adaptive Antennas in Third-Generation Mobile Communications Systems: Chapter 5", Doctor of Philosophy Dissertation, Curtin University of Technology, Nov. 2002, 27 pages.
Lau, Buon Kiong, "Applications of Adaptive Antennas in Third-Generation Mobile Communications Systems: Chapter 2", Doctor of Philosophy Dissertation, Curtin University of Technology, Nov. 2002, 50 pages.
DeBrunner, et al., "Multiple Fully Adaptive Notch Filter Design Based on Allpass Sections", IEEE Transactions on Signal Processing 2000, vol. 48, No. 2, Feb. 2000, pp. 55-552.
Cao, et al., "An Auto Tracking Beamforming Microphone Array for Sound Recording", Audio Engineering Society, Fifth Australian Regional Convention, Apr. 26-28, 1995, Sydney, Australia, 9 pages.
Tan, et al., "On the Application of Circular Arrays in Direction Finding: Part I: Investigation into the Estimation Algorithms", 1st Annual COST 273 Workshop, Espoo, Finland, May 29-30, 2002, pp. 1-8.
Abreu, et al., "Chebyshev-Like Low Sidelobe Beampatterns with Adjustable Beamwidth and Steering-Invariance", European Wireless Conference 2002, Feb. 26, 2002, 7 pages.
Zhang, et al., "Adaptive Beamforming by Microphone Arrays", IEEE Global Telecommunications Conference 1995, Nov. 14-16, 1995, pp. 163-167.
Potamitis, Ilyas, "Estimation of Speech Presence Probability in the Field of Microphone Array", IEEE Signal Processing Letters 2004, vol. 11, No. 12, Dec. 2004, 4 pages.
Pham, et al., "Wideband Array Processing Algorithms for Acoustic Tracking of Ground Vehicles", U.S. Army Research Laboratory, Proceedings of the 21st Army Science Conference, 1998, 9 pages.
Cevher, et al., "Tracking of Multiple Wideband Targets Using Passive Sensor Arrays and Particle Filters", Proceedings of the 10th IEEE Digital Signal Processing Workshop 2002 and Proceedings of the 2nd Signal Processing Education Workshop 2002, Oct. 13-16, 2002, pp. 72-77.
Kellerman, Walter, "Integrating Acoustic Echo Cancellation with Adaptive Beamforming Microphone Arrays", Forum Acusticum, Berlin, Mar. 14-19, 1999, 4 pages.

Manikas, et al., "Comparison of the ultimate direction-finding capabilities of a number of planar array geometries", IEE Proceedings on Radar, Sonar, and Navigation 1997, vol. 144, Issue 6, Dec. 1997, pp. 321-329.
Haynes, Toby, "A Primer on Digital Beamforming", Spectrum Signal Processing, Mar. 26, 1998, pp. 1-15.
Friedlander, et al., "Direction Finding for Wide-Band Signals Using an Interpolated Array", IEEE Transactions on Signal Processings, vol. 41, No. 4, Apr. 1993, pp. 1618-1634.
Van Gerven, et al., "Multiple Beam Broadband Beamforming: Filter Design and Real-Time Implementation", IEEE ASSP Workshop on Applications of Signal Processing to Audio and Acoustics 1995, Oct. 15-18, 1995, pp. 173-176.
Tang, et al., "Optimum Design on Time Domain Wideband Beamformer with Constant Beamwidth for Sonar Systems", Oceans 2004, MTTS/IEEE TECHNO-Ocean 2004, Nov. 9-12, 2004, vol. 2, pp. 626-630.
Pirinen, et al., "Time Delay Based Failure-Robust Direction of Arrival Estimation", Proceedings of the 3rd IEEE Sensor Array and Multichannel Signal Processing Workshop 2004, Jul. 18-21, 2004, pp. 618-622.
Dietrich, Jr., Carl B., "Adaptive Arrays and Diversity Antenna Configurations for Handheld Wireless Communication Terminals—Chapter 3: Antenna Arrays and Beamforming", Doctoral Dissertation, Virginia Tech, Feb. 15, 2005, 24 pages.
Perez-Neira, et al., "Cross-Coupled DOA Trackers", IEEE Transactions on Signal Processing 1997, vol. 45, No. 10, Oct. 1997, pp. 2560-2565.
Tewfik, et al., "On the Application of Uniform Linear Array Bearing Estimation Techniques to Uniform Circular Arrays", IEEE Transactions on Signal Processing 1992, vol. 40, No. 4, Apr. 1993, pp. 1008-1011.
Ye, et al., "2-D Angle Estimation with a Uniform Circular Array via RELAX", Proceedings of IEEE International Conference on Computational Electromagnetics and Its Applications 1999, pp. 175-178.
Orfanidis, Sophocles J., "Electromagnetic Waves and Antennas: Chapter 19", MATLAB, Feb. 2004, pp. 649-688.
Lau, Buon Kiong, "Applications of Adaptive Antennas in Third-Generation Mobile Communications Systems—Chapter 6: Optimum Beamforming", Doctoral Thesis, Curtin University of Technology, 2002, 15 pages.
Lau, et al., "Direction of Arrival Estimation in the Presence of Correlated Signals and Array Imperfections with Uniform Circular Arrays", Proceedings of the IEEE International Conference on Acoustics, Speech, and Signal Processing 2002, Aug. 7, 2002, vol. 3, pp. III-3037-III3040.
Moody, M.P., "Resolution of Coherent Sources Incident on a Circular Antenna Array", Proceedings of the IEEE, vol. 68, No. 2, Feb. 1980, p. 276-277.
Angus, et al., "An Adaptive Beam-Steering Microphone Array Implemented on the Motorola DSP56000 Digital Signal Processor", 95th Audio Engineering Society Convention, Oct. 7-10, 1993, 24 pages.
Lau, et al., "Transformations for Nonideal Uniform Circular Arrays Operating in Correlated Signal Environments", IEEE Transactions on Signal Processing, vol. 54, No. 1, Jan. 2006, pp. 34-48.
Ioannides, et al., "Uniform Circular Arrays for Smart Antennas", IEEE Antennas and Propagation Magazine, vol. 47, No. 4, Aug. 2005, pp. 192-208.
Davies, D.E.N.; "A transformation between the phasing techniques required for linear and circular aerial arrays"; Proceedings of the IEE, vol. 112 No. 11; Nov. 1965; 5 pages.
Joe Duran and Charlie Sauer; "Mainstream Videoconferencing—A Developer's Guide to Distance Multimedia"; Jan. 1997; pp. 235-238; Addison Wesley Longman, Inc.
Per Hyberg; "Antenna Array Mapping for DOA Estimation in Radio Signal Reconnaissance, Chapter 4: Analytical UCA to ULA Transformations"; Royal Institute of Technology, Stockholm, Sweden; 2005; pp. 43-50.
Ivan Tashev and Henrique S. Malvar; "A New Beamformer Design Algorithm for Microphone Arrays"; IEEE International Conference on Acoustics, Speech, and Signal Processing 2005; Mar. 18-23, 2005; 4 pages.
Harvey Dillon; "Hearing Aids"; Boomerang Press; Jan. 2001, p. 191.
Paul R. Karmel, Gabriel D. Colef, and Raymond L. Camisa; "Introduction to Electromagnetic and Microwave Engineering"; John Wiley & Sons, Inc.; 1998; p. 661.

* cited by examiner

TRACKING TALKERS USING VIRTUAL BROADSIDE SCAN AND DIRECTED BEAMS

CONTINUITY DATA

This application claims priority to U.S. Provisional Application No. 60/676,415, filed on Apr. 29, 2005, entitled "Speakerphone Functionality", invented by William V. Oxford, Vijay Varadarajan and Ioannis S. Dedes, which is hereby incorporated by reference in its entirety.

BACKGROUND OF THE INVENTION

1. Field of the Invention

The present invention relates generally to the field of communication devices and, more specifically, to speakerphones.

2. Description of the Related Art

Speakerphones may be used to mediate conversations between local persons and remote persons. A speakerphone may have a microphone to pick up the voices of the local persons (in the environment of the speakerphone), and, a speaker to audibly present a replica of the voices of the remote persons. While speakerphones may allow a number of people to participate in a conference call, there are a number of problems associated with the use of speakerphones.

The microphone picks up not only the voices of the local persons but also the signal transmitted from the speaker and its reflections off of acoustically reflective structures in the environment). To make the received signal (from the microphone) more intelligible the speakerphone may attempt to perform acoustic echo cancellation. Any means for increasing the efficiency and effectiveness of acoustic echo cancellation is greatly to be desired.

Sometimes one or more of the local persons may be speaking at the same time. Thus, it would be desirable to have some means of extracting the voices of the one or more persons from ambient noise and sending to the remote speakerphone a signal representing these one or more extracted voices.

Sometimes a noise source such as a fan may interfere with the intelligibility of the voices of the local persons. Furthermore, a noise source may be positioned near one of the local persons (e.g., near in angular position as perceived by the speakerphone). Thus, it would desirable to have a means for suppressing noise sources that are situated close to talking persons.

It is difficult for administrators to maintain control on the use of communication devices when users may move the devices without informing the administrator. Thus, there exists a need for a system and mechanism capable of locating the communication devices and/or detecting if (and when) the devices are moved.

The well known proximity effect can make a talker who is close to a directional microphone have much more low-frequency boost than one that is farther away from the same directional microphone. There exist a need for a mechanism capable of compensating for the proximity effect in a speakerphone (or other communication device).

When a person talks, his/her voice echoes off of acoustically reflective structures in the room. The microphone picks up not only the direct path transmission from the talker to the microphone, but the echoes as well. Thus, there exists a need for mechanisms capable of canceling these echoes.

A speakerphone may send audio information to/from other devices using standard codecs. Thus, there exists a need for mechanisms of capable of increasing the performance of data transfers between the speakerphone and other devices, especially when using standard codecs.

SUMMARY

In one set of embodiments, a method for capturing the voices of one or more talkers (e.g., simultaneous talkers) may involve:

- performing a virtual broadside scan to obtain an amplitude envelope;
- identifying angles of acoustic sources from peaks in the amplitude envelope;
- examining each of the source angles with a highly directed beam to obtain a corresponding beam signal;
- classifying each source as intelligence or noise based on analysis of spectral characteristics of the corresponding beam signal;
- of those sources that are classified as intelligence, identifying one or more having highest amplitudes;
- combining the beam signals corresponding to the one or more intelligence sources having highest amplitudes into an output signal.

In another set of embodiments, a method for capturing one or more sources of acoustic intelligence may involve:

(a) identifying one or more angles of one or more acoustic sources from peaks in an amplitude envelope, wherein the amplitude envelope corresponds to an output of a visual boardside scan on blocks of input signal samples, one block from each microphone in an array of microphones;

(b) for each of the source angles, operating on the input signal blocks with a directed beam pointed in the direction of the source angle to obtain a corresponding beam signal;

(c) classifying each source as intelligence or noise based on analysis of spectral characteristics of the corresponding beam signal;

(d) of those one or more sources that are classified as intelligence, identifying one or more sources whose corresponding beams signals have highest energies; and (e) generating an output signal from the one or more beam signals corresponding to the one or more intelligence sources having highest energies.

The method may further comprise performing a virtual broadside scan on the blocks of input signal samples to generate the amplitude envelope. In some embodiments, the performance of the virtual broadside scan and operations (a) through (e) may be repeated in order to track talkers as they move, to add new directed beams for persons that start talking, and to drop the directed beams for persons that have gone silent.

The output signal may be transmitted to one or more remote devices, e.g., devices such as speakerphones, videoconferencing systems, computers, cell phones, personal digital assistants, etc. A remote device may receive the output signal and provide the output signal to a speaker. Because the output signal is generated from directed beam signals, the remote participants, situated near the remote device, are able to hear a quality representation of the speech (or other sounds) generated by the local participants, even in the situation where more than one local participant is talking at the same time, and even when there are interfering noise sources present in the local environment.

The array of microphones may be arranged on a circle, an ellipse, a square, a rectangle, etc. Furthermore, the microphones may be arranges on a 2D grid, e.g., a rectangular grid or a hexagonal grid. In some embodiments, the microphones are arranged in a 3D pattern, e.g., on the surface of a hemisphere.

In one set of embodiments, the microphones of the array are nominally omni-directional microphones.

The operation of identifying one or more angles of one or more acoustic sources from peaks in an amplitude envelope may include:

(1) estimating an angular position of a first peak in the amplitude envelope;

(2) constructing a shifted and scaled version of a virtual broadside response pattern using the angular position and an amplitude of the first peak; and (3) subtracting the shifted and scaled version from the amplitude envelope to obtain an update to the amplitude envelope.

The operations (1)-(3) may be repeated a number of times. Each repetition of (1)-(3) may operate on the updated amplitude envelope from the previous repetition.

Any of the various method embodiments disclosed herein (or any combinations thereof or portions thereof) may be implemented in terms of program instructions. The program instructions may be stored in (or on) any of various memory media. For example, in one embodiment, a memory medium may be configured to store program instructions, where the program instructions are executable to implement:

(a) identifying one or more angles of one or more acoustic sources from peaks in an amplitude envelope, wherein the amplitude envelope corresponds to an output of a virtual broadside scan on blocks of input signal samples, one block from each microphone in an array of microphones;

(b) for each of the source angles, operating on the input signal blocks with a directed beam pointed in the direction of the source angle to obtain a corresponding beam signal;

(c) classifying each source as intelligence or noise based on analysis of spectral characteristics of the corresponding beam signal;

(d) of those one or more sources that are classified as intelligence, identifying one or more sources whose corresponding beams signals have highest energies;

(e) generating an output signal from the one or more beam signals corresponding to the one or more intelligence sources having highest energies.

A memory medium is a medium configured for the storage of information. Examples of memory media include various kinds of magnetic media (e.g., magnetic tape or magnetic disk); various kinds of optical media (e.g., CD-ROM); various kinds of semiconductor RAM and ROM; various media based on the storage of electrical charge or other physical quantities; etc.

Furthermore, various embodiments of a system including a memory and a processor (or set of processors) are contemplated, where the memory is configured to store program instructions and the processor is configured to read and execute the program instructions from the memory. In various embodiments, the program instructions encode corresponding ones of the method embodiments described herein (or combinations thereof or portions thereof). For example, in one embodiment, the program instructions are configured to implement:

(a) identifying one or more angles of one or more acoustic sources from peaks in an amplitude envelope, wherein the amplitude envelope corresponds to an output of a virtual broadside scan on blocks of input signal samples, one block from each microphone in an array of microphones;

(b) for each of the source angles, operating on the input signal blocks with a directed beam pointed in the direction of the source angle to obtain a corresponding beam signal;

(c) classifying each source as intelligence or noise based on analysis of spectral characteristics of the corresponding beam signal;

(d) of those one or more sources that are classified as intelligence, identifying one or more sources whose corresponding beams signals have highest energies;

(e) generating an output signal from the one or more beam signals corresponding to the one or more intelligence sources having highest energies.

Embodiments are contemplated where actions (a) through (e) are partitioned among a set of processors in order to increase computational throughput.

The system may also include the array of microphones. For example, an embodiment of the system targeted for realization as a speakerphone may include the array of microphones.

BRIEF DESCRIPTION OF THE DRAWINGS

The following detailed description makes reference to the accompanying drawings, which are now briefly described.

While the invention is described herein by way of example for several embodiments and illustrative drawings, those skilled in the art will recognize that the invention is not limited to the embodiments or drawings described. It should be understood, that the drawings and detailed description thereto are not intended to limit the invention to the particular form disclosed, but on the contrary, the intention is to cover all modifications, equivalents and alternatives falling within the spirit and scope of the present invention as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including, but not limited to.

DETAILED DESCRIPTION OF THE PREFERRED EMBODIMENTS

Incorporations by Reference

U.S. Provisional Application No. 60/676,415, filed on Apr. 29, 2005, entitled "Speakerphone Functionality", invented by William V. Oxford, Vijay Varadarajan and Ioannis S. Dedes, is hereby incorporated by reference in its entirety.

U.S. patent application Ser. No. 11/251,084, filed on Oct. 14, 2005, entitled "Speakerphone", invented by William V. Oxford, is hereby incorporated by reference in its entirety.

U.S. patent application Ser. No. 11/108,341, filed on Apr. 18, 2005, entitled "Speakerphone Self Calibration and Beam Forming", invented by William V. Oxford and Vijay Varadarajan, is hereby incorporated by reference in its entirety.

U.S. Provisional Patent Application titled "Video Conferencing Speakerphone", Ser. No. 60/619,212, which was filed Oct. 15, 2004, whose inventors are Michael L. Kenoyer, Craig B. Malloy, and Wayne E. Mock is hereby incorporated by reference in its entirety.

U.S. Provisional Patent Application titled "Video Conference Call System", Ser. No. 60/619,210, which was filed Oct. 15, 2004, whose inventors are Michael J. Burkett, Ashish Goyal, Michael V. Jenkins, Michael L. Kenoyer, Craig B. Malloy, and Jonathan W. Tracey is hereby incorporated by reference in its entirety.

U.S. Provisional Patent Application titled "High Definition Camera and Mount", Ser. No. 60/619,227, which was filed Oct. 15, 2004, whose inventors are Michael L. Kenoyer, Patrick D. Vanderwilt, Paul D. Frey, Paul Leslie Howard, Jonathan I. Kaplan, and Branko Lukic, is hereby incorporated by reference in its entirety.

List of Acronyms Used Herein

Figure 1A:
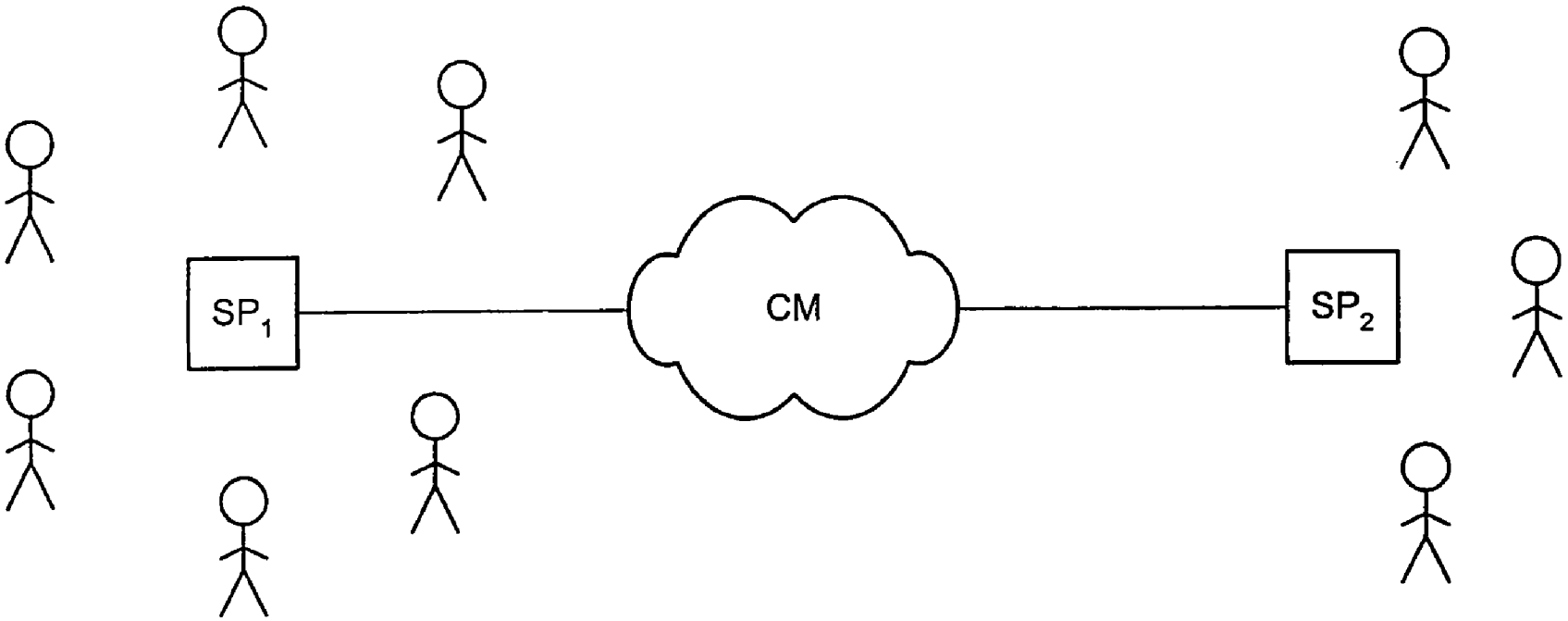
FIG. 1A illustrates communication system including two speakerphones coupled through a communication mechanism.

DDR SDRAM=Double-Data-Rate Synchronous Dynamic RAM
DRAM=Dynamic RAM
FIFO=First-In First-Out Buffer
FIR=Finite Impulse Response
FFT=Fast Fourier Transform
Hz=Hertz
IIR=Infinite Impulse Response
ISDN=Integrated Services Digital Network
kHz=kiloHertz
PSTN=Public Switched Telephone Network
RAM=Random Access Memory
RDRAM=Rambus Dynamic RAM
ROM=Read Only Memory
SDRAM=Synchronous Dynamic Random Access Memory
SRAM=Static RAM A communication system may be configured to facilitate voice communication between participants (or groups of participants) who are physically separated as suggested by FIG. 1A. The communication system may include a first speakerphone $SP_1$ and a second speakerphone $SP_2$ coupled through a communication mechanism CM. The communication mechanism CM may be realized by any of a wide variety of well known communication technologies. For example, communication mechanism CM may be the PSTN (public switched telephone network) or a computer network such as the Internet.

Speakerphone Block Diagram

Figure 1B:
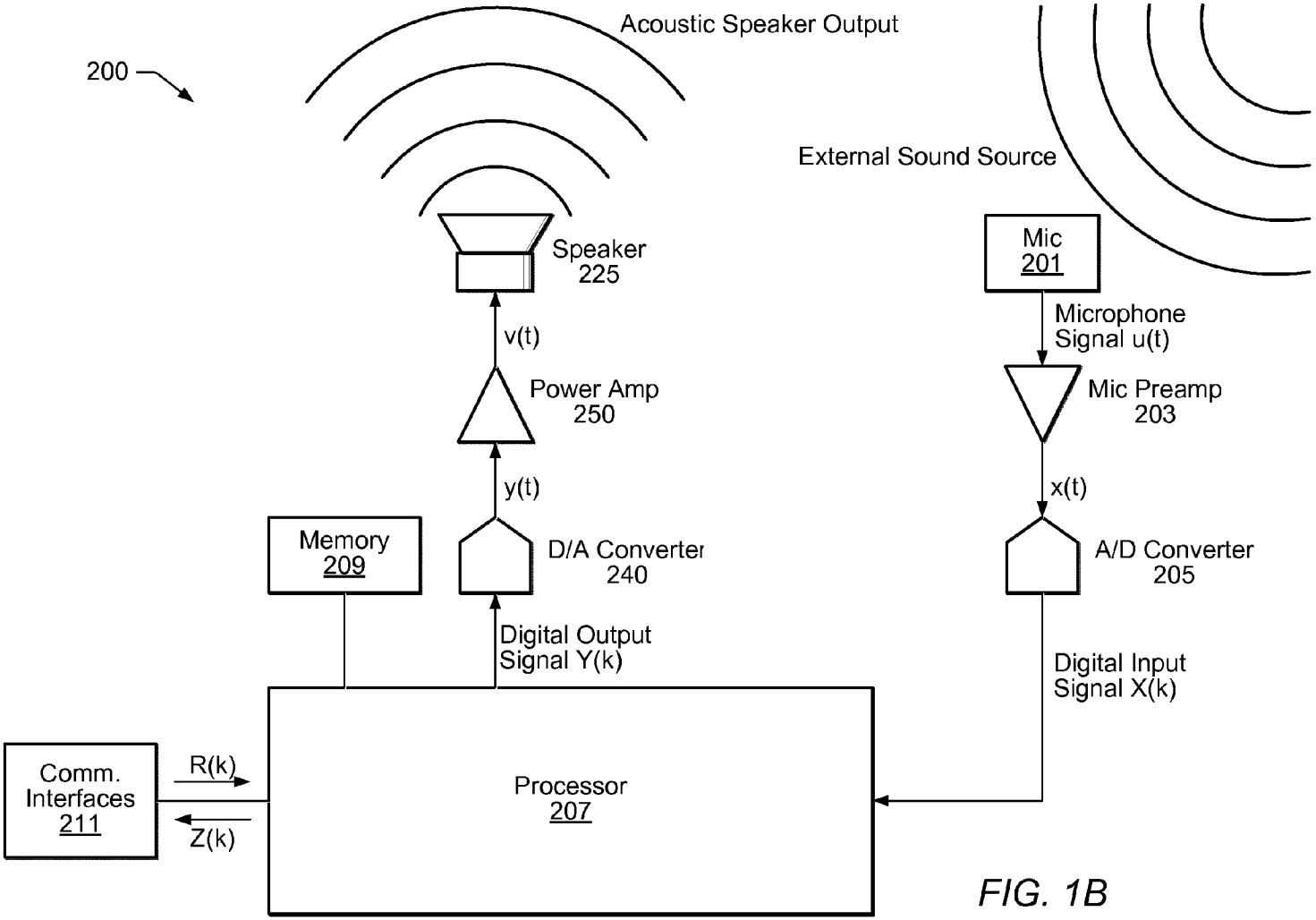
FIG. 1B illustrates one set of embodiments of a speakerphone system 200.

FIG. 1B illustrates a speakerphone 200 according to one set of embodiments. The speakerphone 200 may include a processor 207 (or a set of processors), memory 209, a set 211 of one or more communication interfaces, an input subsystem and an output subsystem.

The processor 207 is configured to read program instructions which have been stored in memory 209 and to execute the program instructions in order to enact any of the various methods described herein.

Memory 209 may include any of various kinds of semiconductor memory or combinations thereof. For example, in one embodiment, memory 209 may include a combination of Flash ROM and DDR SDRAM.

The input subsystem may include a microphone 201 (e.g., an electret microphone), a microphone preamplifier 203 and an analog-to-digital (A/D) converter 205. The microphone 201 receives an acoustic signal A(t) from the environment and converts the acoustic signal into an electrical signal u(t). (The variable t denotes time.) The microphone preamplifier 203 amplifies the electrical signal u(t) to produce an amplified signal x(t). The A/D converter samples the amplified signal x(t) to generate digital input signal X(k). The digital input signal X(k) is provided to processor 207.

In some embodiments, the A/D converter may be configured to sample the amplified signal x(t) at least at the Nyquist rate for speech signals. In other embodiments, the A/D converter may be configured to sample the amplified signal x(t) at least at the Nyquist rate for audio signals.

Processor 207 may operate on the digital input signal X(k) to remove various sources of noise, and thus, generate a corrected microphone signal Z(k). The processor 207 may send the corrected microphone signal Z(k) to one or more remote devices (e.g., a remote speakerphone) through one or more of the set 211 of communication interfaces.

The set 211 of communication interfaces may include a number of interfaces for communicating with other devices (e.g., computers or other speakerphones) through well-known communication media. For example, in various embodiments, the set 211 includes a network interface (e.g., an Ethernet bridge), an ISDN interface, a PSTN interface, or, any combination of these interfaces.

The speakerphone 200 may be configured to communicate with other speakerphones over a network (e.g., an Internet Protocol based network) using the network interface. In one embodiment, the speakerphone 200 is configured so multiple speakerphones, including speakerphone 200, may be coupled together in a daisy chain configuration.

The output subsystem may include a digital-to-analog (D/A) converter 240, a power amplifier 250 and a speaker 225. The processor 207 may provide a digital output signal Y(k) to the D/A converter 240. The D/A converter 240 converts the digital output signal Y(k) to an analog signal y(t). The power amplifier 250 amplifies the analog signal y(t) to generate an amplified signal v(t). The amplified signal v(t) drives the speaker 225. The speaker 225 generates an acoustic output signal in response to the amplified signal v(t).

Processor 207 may receive a remote audio signal R(k) from a remote speakerphone through one of the communication interfaces and mix the remote audio signal R(k) with any locally generated signals (e.g., beeps or tones) in order to generate the digital output signal Y(k). Thus, the acoustic signal radiated by speaker 225 may be a replica of the acoustic signals (e.g., voice signals) produced by remote conference participants situated near the remote speakerphone.

In one alternative embodiment, the speakerphone may include circuitry external to the processor 207 to perform the mixing of the remote audio signal R(k) with any locally generated signals.

In general, the digital input signal X(k) represents a superposition of contributions due to:

- acoustic signals (e.g., voice signals) generated by one or more persons (e.g., conference participants) in the environment of the speakerphone 200, and reflections of these acoustic signals off of acoustically reflective surfaces in the environment;
- acoustic signals generated by one or more noise sources (such as fans and motors, automobile traffic and fluorescent light fixtures) and reflections of these acoustic signals off of acoustically reflective surfaces in the environment; and the acoustic signal generated by the speaker 225 and the reflections of this acoustic signal off of acoustically reflective surfaces in the environment.

Processor 207 may be configured to execute software including an acoustic echo cancellation (AEC) module. The AEC module attempts to estimate the sum C(k) of the contributions to the digital input signal X(k) due to the acoustic signal generated by the speaker and a number of its reflections, and, to subtract this sum C(k) from the digital input signal X(k) so that the corrected microphone signal Z(k) may be a higher quality representation of the acoustic signals generated by the local conference participants.

In one set of embodiments, the AEC module may be configured to perform many (or all) of its operations in the frequency domain instead of in the time domain. Thus, the AEC module may:

- estimate the Fourier spectrum C(ω) of the signal C(k) instead of the signal C(k) itself, and
- subtract the spectrum C(ω) from the spectrum X(ω) of the input signal X(k) in order to obtain a spectrum Z(ω).

An inverse Fourier transform may be performed on the spectrum Z(ω) to obtain the corrected microphone signal Z(k). As used herein, the "spectrum" of a signal is the Fourier transform (e.g., the FFT) of the signal.

In order to estimate the spectrum C(ω), the acoustic echo cancellation module may utilize:

- the spectrum Y(ω) of a set of samples of the output signal Y(k), and
- modeling information $I_M$ describing the input-output behavior of the system elements (or combinations of system elements) between the circuit nodes corresponding to signals Y(k) and X(k).

For example, in one set of embodiments, the modeling information $I_M$ may include:

(a) a gain of the D/A converter 240;
(b) a gain of the power amplifier 250;
(c) an input-output model for the speaker 225;
(d) parameters characterizing a transfer function for the direct path and reflected path transmissions between the output of speaker 225 and the input of microphone 201;
(e) a transfer function of the microphone 201;
(f) a gain of the preamplifier 203;
(g) a gain of the A/D converter 205.

Figure 2:
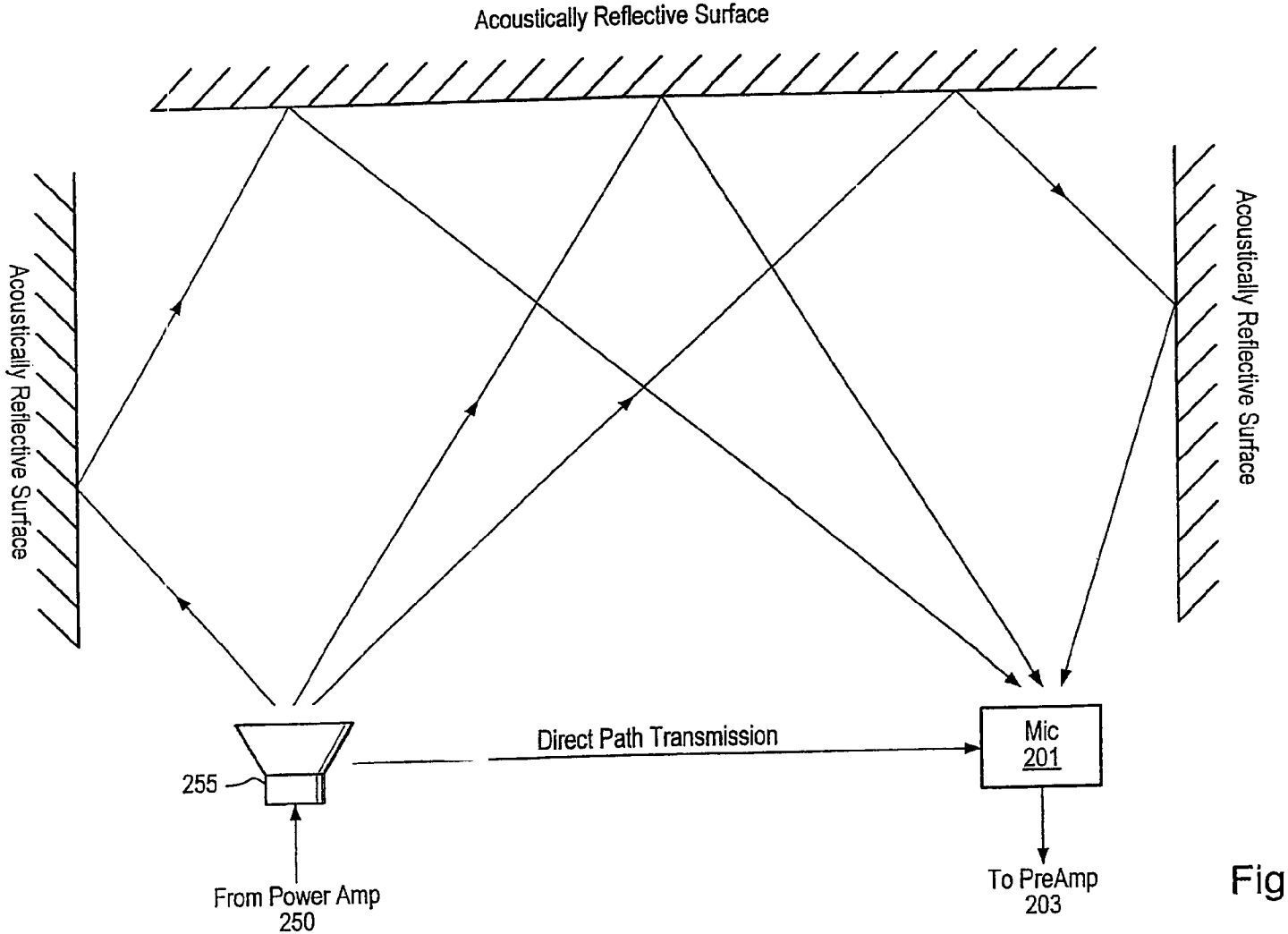
FIG. 2 illustrates a direct path transmission and three examples of reflected path transmissions between the speaker 255 and microphone 201.

The parameters (d) may include attenuation coefficients and propagation delay times for the direct path transmission and a set of the reflected path transmissions between the output of speaker 225 and the input of microphone 201. FIG. 2 illustrates the direct path transmission and three reflected path transmission examples.

In some embodiments, the input-output model for the speaker may be (or may include) a nonlinear Volterra series model, e.g., a Volterra series model of the form:

$$f_S(k) = \sum_{i=0}^{N_a-1} a_i v(k-i) + \sum_{i=0}^{N_b-1} \sum_{j=0}^{M_b-1} b_{ij} v(k-i) \cdot v(k-j), \tag{1}$$

where v(k) represents a discrete-time version of the speaker's input signal, where $f_s(k)$ represents a discrete-time version of the speaker's acoustic output signal, where $N_a$, $N_b$ and $M_b$ are positive integers. For example, in one embodiment, $N_a$=8, $N_b$=3 and $M_b$=2. Expression (1) has the form of a quadratic polynomial. Other embodiments using higher order polynomials are contemplated.

In alternative embodiments, the input-output model for the speaker is a transfer function (or equivalently, an impulse response).

In one embodiment, the AEC module may compute the compensation spectrum C(ω) using the output spectrum Y(ω) and the modeling information $I_M$ (including previously estimated values of the parameters (d)). Furthermore, the AEC module may compute an update for the parameters (d) using the output spectrum Y(ω), the input spectrum X(ω), and at least a subset of the modeling information $I_M$ (possibly including the previously estimated values of the parameters (d)).

In another embodiment, the AEC module may update the parameters (d) before computing the compensation spectrum C(ω).

In those embodiments where the speaker input-output model is a nonlinear model (such as a Volterra series model), the AEC module may be able to converge more quickly and/or achieve greater accuracy in its estimation of the attenuation coefficients and delay times (of the direct path and reflected paths) because it will have access to a more accurate representation of the actual acoustic output of the speaker than in those embodiments where a linear model (e.g., a transfer function) is used to model the speaker.

In some embodiments, the AEC module may employ one or more computational algorithms that are well known in the field of echo cancellation.

The modeling information $I_M$ (or certain portions of the modeling information $I_M$) may be initially determined by measurements performed at a testing facility prior to sale or distribution of the speakerphone 200. Furthermore, certain portions of the modeling information $I_M$ (e.g., those portions that are likely to change over time) may be repeatedly updated based on operations performed during the lifetime of the speakerphone 200.

In one embodiment, an update to the modeling information $I_M$ may be based on samples of the input signal X(k) and samples of the output signal Y(k) captured during periods of time when the speakerphone is not being used to conduct a conversation.

In another embodiment, an update to the modeling information $I_M$ may be based on samples of the input signal X(k) and samples of the output signal Y(k) captured while the speakerphone 200 is being used to conduct a conversation.

In yet another embodiment, both kinds of updates to the modeling information $I_M$ may be performed.

Updating Modeling Information based on Offline Calibration Experiments

In one set of embodiments, the processor 207 may be programmed to update the modeling information $I_M$ during a period of time when the speakerphone 200 is not being used to conduct a conversation.

The processor 207 may wait for a period of relative silence in the acoustic environment. For example, if the average power in the input signal X(k) stays below a certain threshold for a certain minimum amount of time, the processor 207 may reckon that the acoustic environment is sufficiently silent for a calibration experiment. The calibration experiment may be performed as follows.

The processor 207 may output a known noise signal as the digital output signal Y(k). In some embodiments, the noise signal may be a burst of maximum-length-sequence noise, followed by a period of silence. For example, in one embodiment, the noise signal burst may be approximately 2-2.5 seconds long and the following silence period may be approximately 5 seconds long. In some embodiments, the noise signal may be submitted to one or more notch filters (e.g., sharp notch filters), in order to null out one or more frequencies known to causes resonances of structures in the speakerphone, prior to transmission from the speaker.

The processor 207 may capture a block $B_X$ of samples of the digital input signal X(k) in response to the noise signal transmission. The block $B_X$ may be sufficiently large to capture the response to the noise signal and a sufficient number of its reflections for a maximum expected room size.

The block $B_X$ of samples may be stored into a temporary buffer, e.g., a buffer which has been allocated in memory 209.

The processor 207 computes a Fast Fourier Transform (FFT) of the captured block $B_X$ of input signal samples X(k) and an FFT of a corresponding block $B_Y$ of samples of the known noise signal Y(k), and computes an overall transfer function H(ω) for the current experiment according to the relation $$H(\omega)=\mathrm{FFT}(B_X)/\mathrm{FFT}(B_Y), \tag{2}$$

where ω denotes angular frequency. The processor may make special provisions to avoid division by zero.

The processor 207 may operate on the overall transfer function H(ω) to obtain a midrange sensitivity value $s_1$ as follows.

The midrange sensitivity value $s_1$ may be determined by computing an A-weighted average of the magnitude of the overall transfer function H(ω):

$$s_1=\mathrm{SUM}[|H(\omega)|A(\omega),\ \omega \text{ ranging from zero to } \pi]. \tag{3}$$

In some embodiments, the weighting function A(ω) may be designed so as to have low amplitudes:

- at low frequencies where changes in the overall transfer function due to changes in the properties of the speaker are likely to be expressed, and
- at high frequencies where changes in the overall transfer function due to material accumulation on the microphone diaphragm are likely to be expressed.

Figure 3:
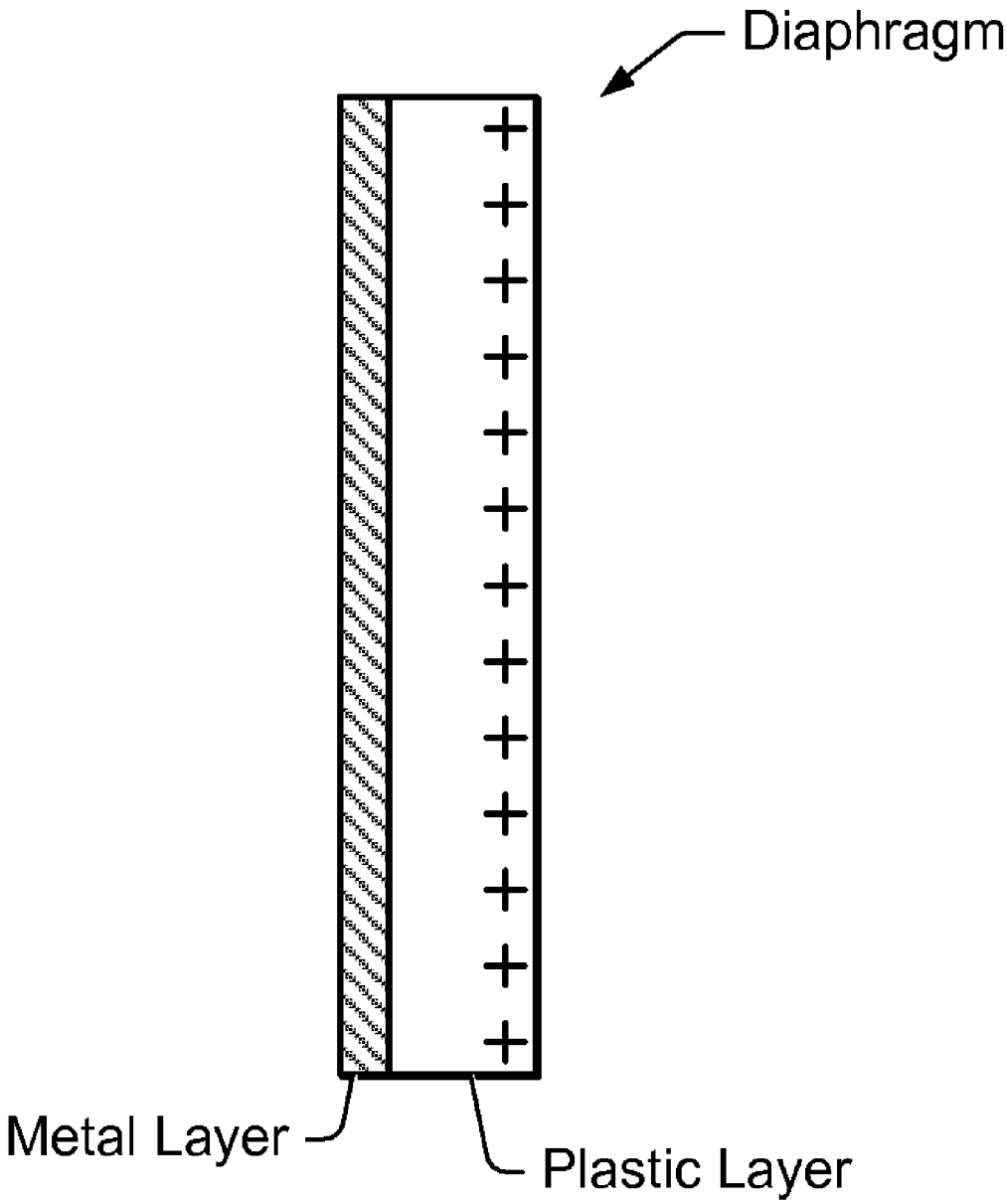
FIG. 3 illustrates a diaphragm of an electret microphone.

The diaphragm of an electret microphone is made of a flexible and electrically non-conductive material such as plastic (e.g., Mylar) as suggested in FIG. 3. Charge (e.g., positive charge) is deposited on one side of the diaphragm at the time of manufacture. A layer of metal may be deposited on the other side of the diaphragm.

Figure 4A:
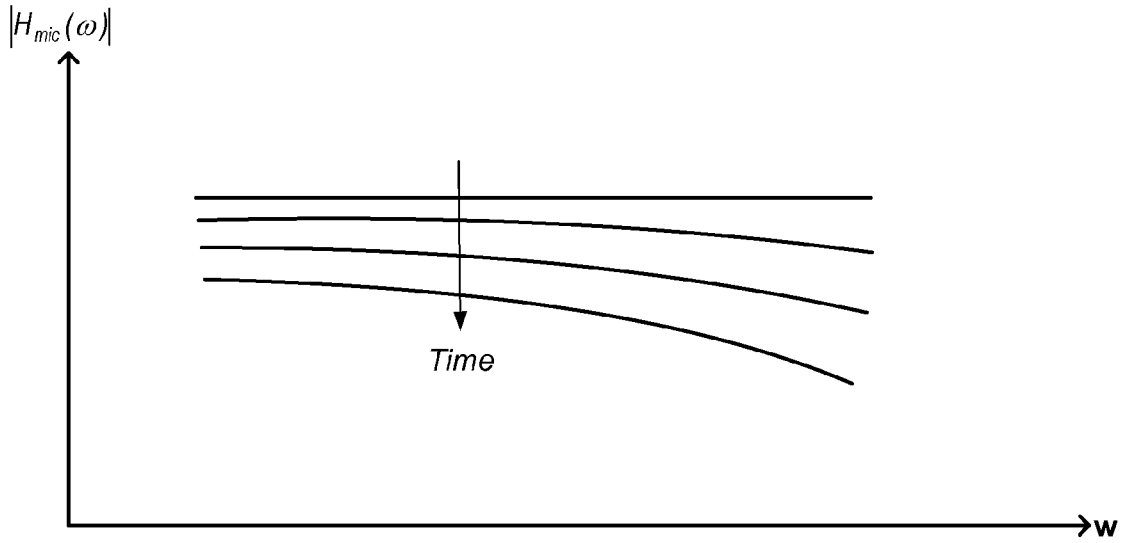
FIG. 4A illustrates the change over time of a microphone transfer function.

As the microphone ages, the deposited charge slowly dissipates, resulting in a gradual loss of sensitivity over all frequencies. Furthermore, as the microphone ages material such as dust and smoke accumulates on the diaphragm, making it gradually less sensitive at high frequencies. The summation of the two effects implies that the amplitude of the microphone transfer function $|H_{mic}(\omega)|$ decreases at all frequencies, but decreases faster at high frequencies as suggested by FIG. 4A. If the speaker were ideal (i.e., did not change its properties over time), the overall transfer function H(ω) would manifest the same kind of changes over time.

Figure 4B:
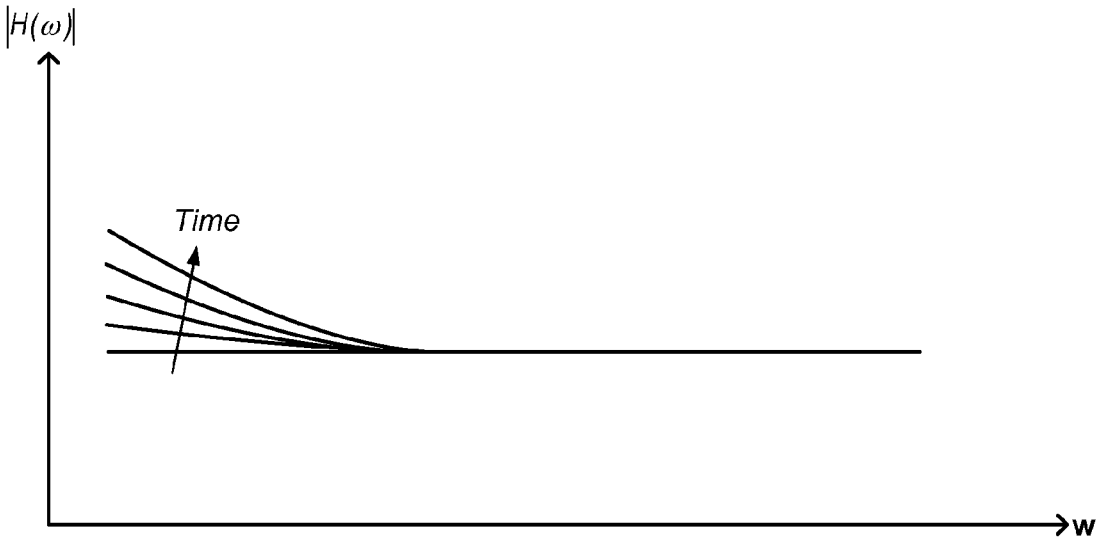
FIG. 4B illustrates the change over time of the overall transfer function due to changes in the properties of the speaker over time under the assumption of an ideal microphone.

The speaker 225 includes a cone and a surround coupling the cone to a frame. The surround is made of a flexible material such as butyl rubber. As the surround ages it becomes more compliant, and thus, the speaker makes larger excursions from its quiescent position in response to the same current stimulus. This effect is more pronounced at lower frequencies and negligible at high frequencies. In addition, the longer excursions at low frequencies implies that the vibrational mechanism of the speaker is driven further into the nonlinear regime. Thus, if the microphone were ideal (i.e., did not change its properties over time), the amplitude of the overall transfer function H(ω) in expression (2) would increase at low frequencies and remain stable at high frequencies, as suggested by FIG. 4B.

The actual change to the overall transfer function H(ω) over time is due to a combination of affects including the speaker aging mechanism and the microphone aging mechanism just described.

In addition to the sensitivity value $s_1$, the processor 207 may compute a lowpass sensitivity value $s_2$ and a speaker related sensitivity $s_3$ as follows. The lowpass sensitivity factor $s_2$ may be determined by computing a lowpass weighted average of the magnitude of the overall transfer function H(ω):

$$s_2=\mathrm{SUM}[|H(\omega)|L(\omega),\ \omega \text{ ranging from zero to } \pi]. \tag{4}$$

Figure 5:
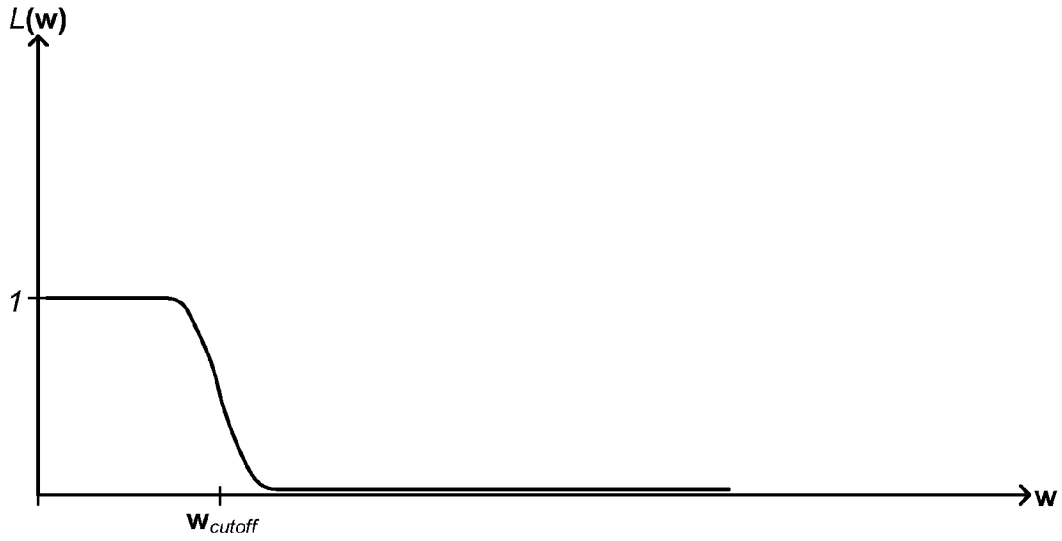
FIG. 5 illustrates a lowpass weighting function $L(\omega)$.

The lowpass weighting function L(ω) equals is equal (or approximately equal) to one at low frequencies and transitions towards zero in the neighborhood of a cutoff frequency. In one embodiment, the lowpass weighting function may smoothly transition to zero as suggested in FIG. 5.

The processor 207 may compute the speaker-related sensitivity value $S_3$ according to the expression:

$$s_3=s_2-s_1.$$

The processor 207 may maintain sensitivity averages $S_1$, $S_2$ and $S_3$ corresponding to the sensitivity values $s_1$, $s_2$ and $s_3$ respectively. The average $S_i$, i=1, 2, 3, represents the average of the sensitivity value $s_i$ from past performances of the calibration experiment.

Furthermore, processor 207 may maintain averages $A_i$ and $B_{ij}$ corresponding respectively to the coefficients $a_i$ and $b_{ij}$ in the Volterra series speaker model. After computing sensitivity value $S_3$, the processor may compute current estimates for the coefficients $b_{ij}$ by performing an iterative search. Any of a wide variety of known search algorithms may be used to perform this iterative search.

In each iteration of the search, the processor may select values for the coefficients $b_{ij}$ and then compute an estimated input signal $X_{EST}(k)$ based on:

the block $B_Y$ of samples of the transmitted noise signal Y(k);

the gain of the D/A converter 240 and the gain of the power amplifier 250;

the modified Voilterra series expression $$f_S(k) = c\sum_{i=0}^{N_a-1} A_i v(k-i) + \sum_{i=0}^{N_b-1}\sum_{j=0}^{M_b-1} b_{ij} v(k-i)\cdot v(k-j), \tag{5}$$

where c is given by $c=s_3/S_3$;

the parameters characterizing the transfer function for the direct path and reflected path transmissions between the output of speaker 225 and the input of microphone 201;

the transfer function of the microphone 201;

the gain of the preamplifier 203; and the gain of the A/D converter 205.

The processor may compute the energy of the difference between the estimated input signal $X_{EST}(k)$ and the block $B_x$ of actually received input samples X(k). If the energy value is sufficiently small, the iterative search may terminate. If the energy value is not sufficiently small, the processor may select a new set of values for the coefficients $b_{ij}$, e.g., using knowledge of the energy values computed in the current iteration and one or more previous iterations.

The scaling of the linear terms in the modified Volterra series expression (5) by factor c serves to increase the probability of successful convergence of the $b_{ij}$.

After having obtained final values for the coefficients $b_{ij}$, the processor 207 may update the average values $B_{ij}$ according to the relations:

$$B_{ij}\leftarrow k_{ij}B_{ij}+(1-k_{ij})b_{ij}, \tag{6}$$

where the values $k_{ij}$ are positive constants between zero and one.

In one embodiment, the processor 207 may update the averages $A_i$ according to the relations:

$$A_i\leftarrow g_iA_i+(1-g_i)(cA_i), \tag{7}$$

where the values $g_i$ are positive constants between zero and one.

In an alternative embodiment, the processor may compute current estimates for the Volterra series coefficients $a_i$ based on another iterative search, this time using the Volterra expression:

$$f_S(k) = \sum_{i=0}^{N_a-1} a_i v(k-i) + \sum_{i=0}^{N_b-1}\sum_{j=0}^{M_b-1} B_{ij} v(k-i)\cdot v(k-j). \tag{8A}$$

After having obtained final values for the coefficients $a_i$, the processor may update the averages $A_i$ according the relations:

$$A_i\leftarrow g_iA_i+(1-g_i)a_i. \tag{8B}$$

The processor may then compute a current estimate $T_{mic}$ of the microphone transfer function based on an iterative search, this time using the Volterra expression:

$$f_s(k) = \sum_{i=0}^{N_a-1} A_i v(k-i) + \sum_{i=0}^{N_b-1}\sum_{j=0}^{M_b-1} B_{ij} v(k-i)\cdot v(k-j). \tag{9}$$

After having obtained a current estimate $T_{mic}$ for the microphone transfer function, the processor may update an average microphone transfer function $H_{mic}$ based on the relation:

$$H_{mic}(\omega)\leftarrow k_mH_{mic}(\omega)+(1-k_m)T_{mic}(\omega), \tag{10}$$

where $k_m$ is a positive constant between zero and one.

Furthermore, the processor may update the average sensitivity values $S_1$, $S_2$ and $S_3$ based respectively on the currently computed sensitivities $s_1$, $S_2$, $S_3$, according to the relations:

$$S_1\leftarrow h_1S_1+(1-h_1)s_1, \tag{11}$$

$$S_2\leftarrow h_2S_2+(1-h_2)s_2, \tag{12}$$

$$S_3\leftarrow h_3S_3+(1-h_3)s_3, \tag{13}$$

where $h_1$, $h_2$, $h_3$ are positive constants between zero and one.

In the discussion above, the average sensitivity values, the Volterra coefficient averages $A_i$ and $B_{ij}$ and the average microphone transfer function $H_{mic}$ are each updated according to an IIR filtering scheme. However, other filtering schemes are contemplated such as FIR filtering (at the expense of storing more past history data), various kinds of nonlinear filtering, etc.

In one set of embodiment system (e.g., a speakerphone or a videoconferencing system) may include a microphone, a speaker, memory and a processor, e.g., as illustrated in FIG. 1B. The memory may be configured to store program instructions and data. The processor is configured to read and execute the program instructions from the memory. The program instructions are executable by the processor to:

(a) output a stimulus signal (e.g., a noise signal) for transmission from the speaker;

(b) receive an input signal from the microphone, corresponding to the stimulus signal and its reverb tail;

(c) compute a midrange sensitivity and a lowpass sensitivity for a spectrum of a transfer function H(ω) derived from a spectrum of the input signal and a spectrum of the stimulus signal;

(d) subtract the midrange sensitivity from the lowpass sensitivity to obtain a speaker-related sensitivity;

(e) perform an iterative search for current values of parameters of an input-output model for the speaker using the input signal spectrum, the stimulus signal spectrum, the speaker-related sensitivity; and (f) update averages of the parameters of the speaker input-output model using the current values obtained in (e).

The parameter averages of the speaker input-output model are usable to perform echo cancellation on other input signals.

The input-output model of the speaker may be a nonlinear model, e.g., a Volterra series model.

Furthermore, in some embodiments, the program instructions may be executable by the processor to:

perform an iterative search for a current transfer function of the microphone using the input signal spectrum, the stimulus signal spectrum, and the current values; and update an average microphone transfer function using the current transfer function.

The average transfer function is also usable to perform said echo cancellation on said other input signals.

Figure 6A:
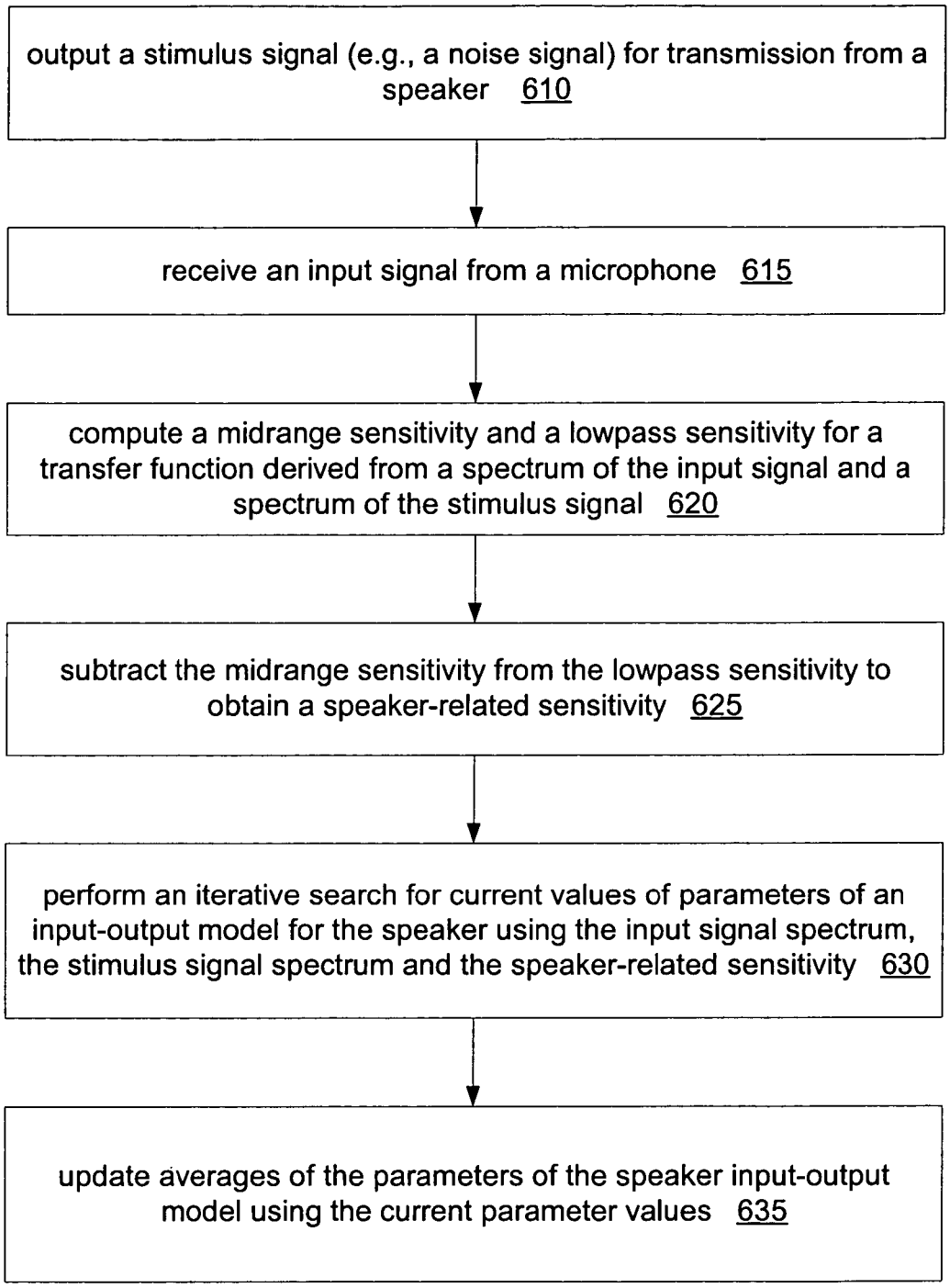
FIG. 6A illustrates one set of embodiments of a method for performing offline self calibration.

In another set of embodiments, as illustrated in FIG. 6A, a method for performing self calibration may involve the following steps:

(a) outputting a stimulus signal (e.g., a noise signal) for transmission from a speaker (as indicated at step 610);

(b) receiving an input signal from a microphone, corresponding to the stimulus signal and its reverb tail (as indicated at step 615);

(c) computing a midrange sensitivity and a lowpass sensitivity for a transfer function H(ω) derived from a spectrum of the input signal and a spectrum of the stimulus signal (as indicated at step 620);

(d) subtracting the midrange sensitivity from the lowpass sensitivity to obtain a speaker-related sensitivity (as indicated at step 625);

(e) performing an iterative search for current values of parameters of an input-output model for the speaker using the input signal spectrum, the stimulus signal spectrum, the speaker-related sensitivity (as indicated at step 630); and (f) updating averages of the parameters of the speaker input-output model using the current parameter values (as indicated at step 635).

The parameter averages of the speaker input-output model are usable to perform echo cancellation on other input signals.

The input-output model of the speaker may be a nonlinear model, e.g., a Volterra series model.

Updating Modeling Information based on Online Data Gathering one set of embodiments, the processor 207 may be programmed to update the modeling information $I_M$ during periods of time when the speakerphone 200 is being used to conduct a conversation.

Suppose speakerphone 200 is being used to conduct a conversation between one or more persons situated near the speakerphone 200 and one or more other persons situated near a remote speakerphone (or videoconferencing system). In this case, the processor 207 sends out the remote audio signal R(k), provided by the remote speakerphone, as the digital output signal Y(k). It would probably be offensive to the local persons if the processor 207 interrupted the conversation to inject a noise transmission into the digital output stream Y(k) for the sake of self calibration. Thus, the processor 207 may perform its self calibration based on samples of the output signal Y(k) while it is "live", i.e., carrying the audio information provided by the remote speakerphone. The self-calibration may be performed as follows.

The processor 207 may start storing samples of the output signal Y(k) into an first FIFO and storing samples of the input signal X(k) into a second FIFO, e.g., FIFOs allocated in memory 209. Furthermore, the processor may scan the samples of the output signal Y(k) to determine when the average power of the output signal Y(k) exceeds (or at least reaches) a certain power threshold. The processor 207 may terminate the storage of the output samples Y(k) into the first FIFO in response to this power condition being satisfied. However, the processor may delay the termination of storage of the input samples X(k) into the second FIFO to allow sufficient time for the capture of a full reverb tail corresponding to the output signal Y(k) for a maximum expected room size.

The processor 207 may then operate, as described above, on a block $B_y$ of output samples stored in the first FIFO and a block $B_x$ of input samples stored in the second FIFO to compute:

(1) current estimates for Volterra coefficients $a_i$ and $b_{ij}$;

(2) a current estimate $T_{mic}$ for the microphone transfer function;

(3) updates for the average Volterra coefficients $A_i$ and $B_{ij}$; and (4) updates for the average microphone transfer function $H_{mic}$.

Because the block $B_x$ of received input samples is captured while the speakerphone 200 is being used to conduct a live conversation, the block $B_x$ is very likely to contain interference (from the point of view of the self calibration) due to the voices of persons in the environment of the microphone 201. Thus, in updating the average values with the respective current estimates, the processor may strongly weight the past history contribution, i.e., more strongly than in those situations described above where the self-calibration is performed during periods of silence in the external environment.

In some embodiments, a system (e.g., a speakerphone or a videoconferencing system) may include a microphone, a speaker, memory and a processor, e.g., as illustrated in FIG. 1B. The memory may be configured to store program instructions and data. The processor is configured to read and execute the program instructions from the memory. The program instructions are executable by the processor to:

(a) provide an output signal for transmission from the speaker, where the output signal carries live signal information from a remote source;

(b) receive an input signal from the microphone, corresponding to the output signal and its reverb tail;

(c) compute a midrange sensitivity and a lowpass sensitivity for a transfer function derived from a spectrum of the input signal and a spectrum of the output signal;

(d) subtract the midrange sensitivity from the lowpass sensitivity to obtain a speaker-related sensitivity;

(e) perform an iterative search for current values of parameters of an input-output model for the speaker using the input signal spectrum, the output signal spectrum, the speaker-related sensitivity; and (f) update averages of the parameters of the speaker input-output model using the current values obtained in (e).

The parameter averages of the speaker input-output model are usable to perform echo cancellation on other input signals (i.e., other blocks of samples of the digital input signal X(k)).

The input-output model of the speaker is a nonlinear model, e.g., a Volterra series model.

Furthermore, in some embodiments, the program instructions may be executable by the processor to:

perform an iterative search for a current transfer function of the microphone using the input signal spectrum, the output signal spectrum, and the current values; and update an average microphone transfer function using the current transfer function.

The current transfer function is usable to perform said echo cancellation on said other input signals.

Figure 6B:
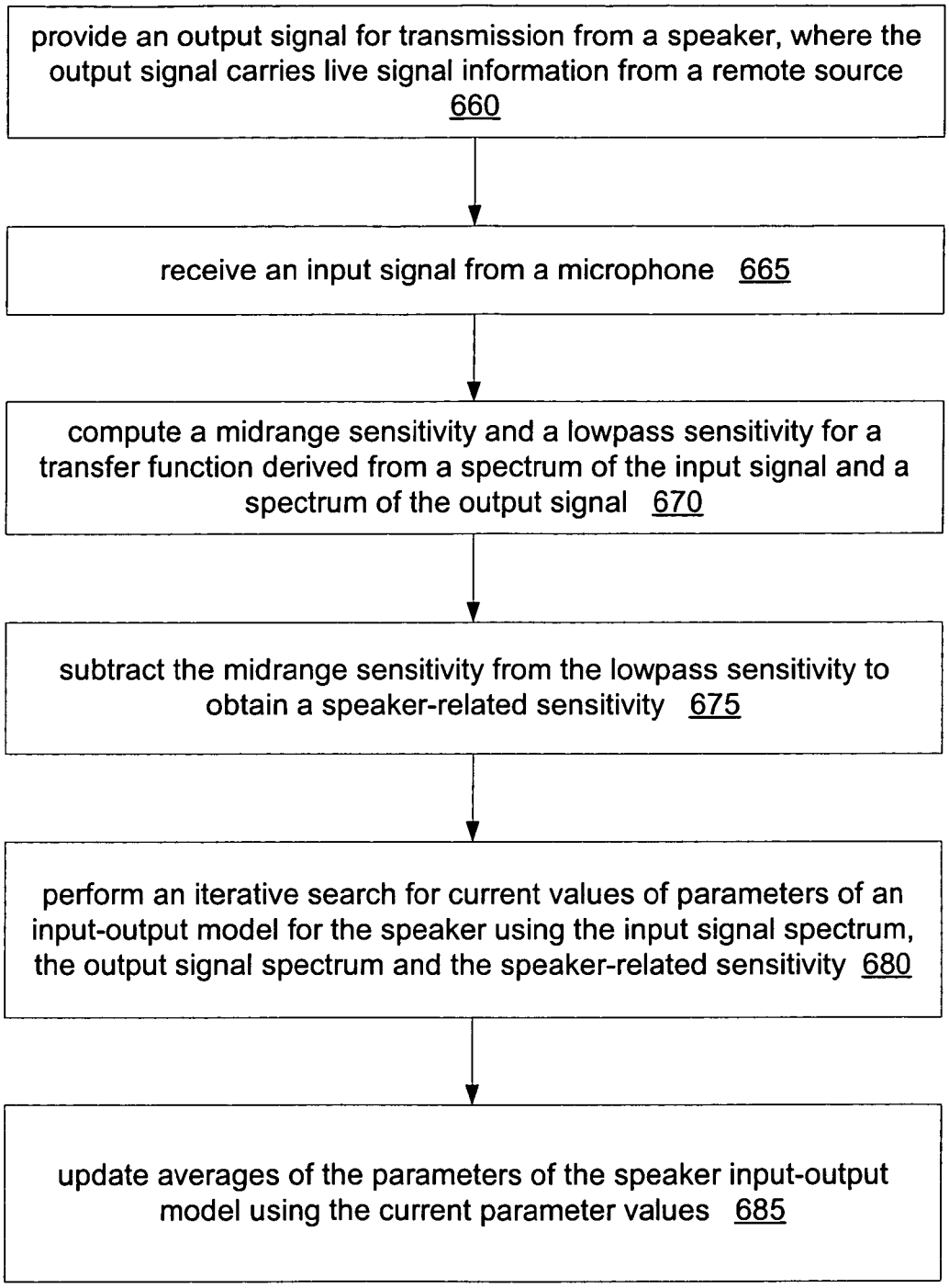
FIG. 6B illustrates one set of embodiments of a method for performing "live" self calibration.

In one set of embodiments, as illustrated in FIG. 6B, a method for performing self calibration may involve:

(a) providing an output signal for transmission from a speaker, where the output signal carries live signal information from a remote source (as indicated at step 660);

(b) receiving an input signal from a microphone, corresponding to the output signal and its reverb tail (as indicated at step 665);

(c) computing a midrange sensitivity and a lowpass sensitivity for a transfer function $H(\omega)$, where the transfer function $H(\omega)$ is derived from a spectrum of the input signal and a spectrum of the output signal (as indicated at step 670);

(d) subtracting the midrange sensitivity from the lowpass sensitivity to obtain a speaker-related sensitivity (as indicated at step 675);

(e) performing an iterative search for current values of parameters of an input-output model for the speaker using the input signal spectrum, the output signal spectrum and the speaker-related sensitivity (as indicated at step 680); and (f) updating averages of the parameters of the speaker input-output model using the current parameter values (as indicated at step 685).

The parameter averages of the speaker input-output model are usable to perform echo cancellation on other input signals.

Furthermore, the method may involve:

performing an iterative search for a current transfer function of the microphone using the input signal spectrum, the spectrum of the output signal, and the current values; and updating an average microphone transfer function using the current transfer function.

The current transfer function is also usable to perform said echo cancellation on said other input signals.

Plurality of Microphones

In some embodiments, the speakerphone 200 may include $N_M$ input channels, where $N_M$ is two or greater. Each input channel $IC_j$, j=1, 2, 3, . . . , $N_M$ may include a microphone $M_j$, a preamplifier $PA_j$, and an A/D converter $ADC_j$. The description given above of various embodiments in the context of one input channel naturally generalizes to $N_M$ input channels.

Let $u_j(t)$ denote the analog electrical signal captured by microphone $M_j$.

Figure 7:
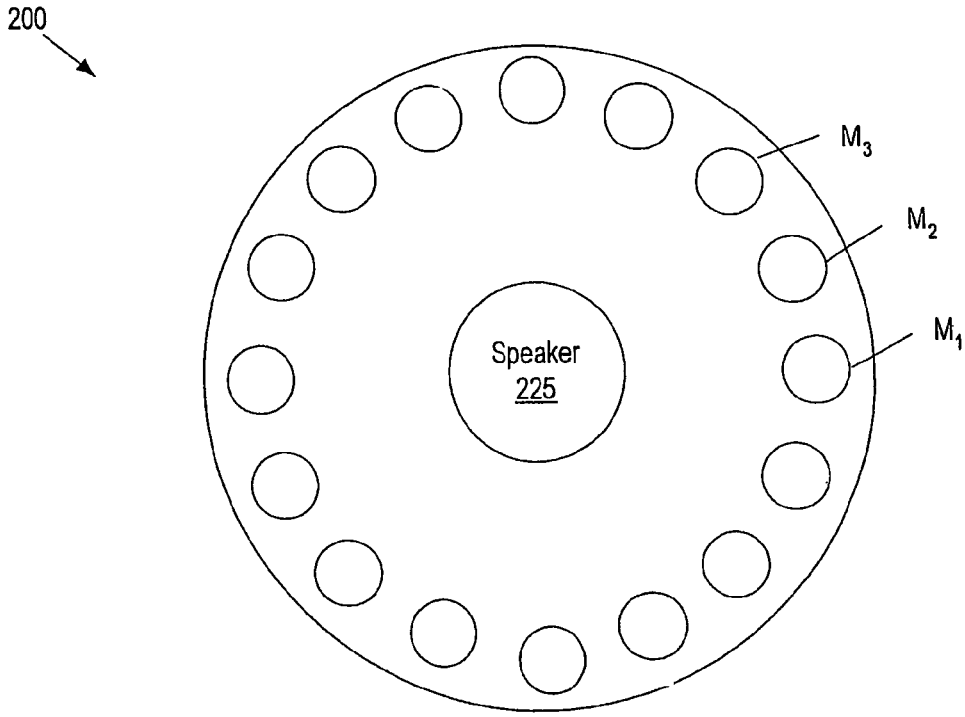
FIG. 7 illustrates one embodiment of speakerphone having a circular array of microphones.

In one group of embodiments, the $N_M$ microphones may be arranged in a circular array with the speaker 225 situated at the center of the circle as suggested by the physical realization (viewed from above) illustrated in FIG. 7. Thus, the delay time $\tau_0$ of the direct path transmission between the speaker and each microphone is approximately the same for all microphones. In one embodiment of this group, the microphones may all be omni-directional microphones having approximately the same transfer function. In this embodiment, the speakerphone 200 may apply the same correction signal e(t) to each microphone signal $u_j(t)$: $r_j(t)=u_j(t)-e(t)$ for j=1, 2, 3, . . . , $N_M$. The use of omni-directional microphones makes it much easier to achieve (or approximate) the condition of approximately equal microphone transfer functions.

Preamplifier $PA_j$ amplifies the difference signal $r_j(t)$ to generate an amplified signal $x_j(t)$. $ADC_j$ samples the amplified signal $x_j(t)$ to obtain a digital input signal $X_j(k)$.

Processor 207 may receive the digital input signals $X_j(k)$, j=1, 2, . . . , $N_M$.

In one embodiment, $N_M$ equals 16. However, a wide variety of other values are contemplated for $N_M$.

There are various ways of orienting the microphones. In some embodiments, each of the microphones $M_j$, j=1, 2, 3, . . . , $N_M$, may be configured with its axis in the oriented vertically so that its diaphragm moves principally up and down. The vertical orientation may enhance the sensitivity of the microphones. In other embodiments, each of the microphones $M_j$, j=1, 2, 3, . . . , $N_M$, may be oriented with its axis in the horizontal plane so that its diaphragm moves principally sideways.

There are various ways of positioning the microphones. In some embodiments, the microphones $M_j$, j=1, 2, 3, . . . , $N_M$, may be positioned in a circular array, e.g., as suggested in FIG. 7. In one embodiment, the microphones of the circular array may be positioned close to the outer perimeter of the speakerphone so as to be as far from the center as possible. (The speaker may be positioned at the center of the speakerphone.)

Various kinds of microphones may be used to realize microphones $M_j$, j=1, 2, 3, . . . , $N_M$. In some embodiments, the microphones $M_j$, j=1, 2, 3, . . . , $N_M$, may be onmi-directional microphones. Various signal processing and/or beam forming computations may be simplified by the use of omni-directional microphones.

In other embodiments, the microphones $M_j$, j=1, 2, 3, . . . , $N_M$, may be directional microphones, e.g., cardioid microphones.

Hybrid Beamforming

As noted above, speakerphone 300 (or speakerphone 200) may include a set of microphones, e.g., as suggested in FIG. 7. In one set of embodiments, processor 207 may operate on the set of digital input signals $X_j(k)$, j=1, 2, . . . , $N_M$, captured from the microphone input channels, to generate a resultant signal D(k) that represents the output of a highly directional virtual microphone pointed in a target direction. The virtual microphone is configured to be much more sensitive in an angular neighborhood of the target direction than outside this angular neighborhood. The virtual microphone allows the speakerphone to "tune in" on any acoustic sources in the angular neighborhood and to "tune out" (or suppress) acoustic sources outside the angular neighborhood.

According to one methodology, the processor 207 may generate the resultant signal D(k) by:

operating on the digital input signals $X_j(k)$, j=1, 2, . . . , $N_M$ with virtual beams B(1), B(2), . . . , B($N_B$) to obtain respective beam-formed signals, where $N_B$ is greater than or equal to two;

adding (perhaps with weighting) the beam-formed signals to obtain a resultant signal D(k).

In one embodiment, this methodology may be implemented in the frequency domain by:

computing a Fourier transform of the digital input signals $X_j(k)$, j=1, 2, . . . , $N_M$, to generate corresponding input spectra $X_j(f)$, j=1, 2, . . . , $N_M$, where f denotes frequency; and operating on the input spectra $X_j(f)$, j=1, 2, . . . , $N_M$ with the virtual beams B(1), B(2), . . . , B($N_B$) to obtain respective beam formed spectra V(1), V(2), . . . , V($N_B$), where $N_B$ is greater than or equal to two;

adding (perhaps with weighting) the spectra V(1), V(2), . . . , V($N_B$) to obtain a resultant spectrum D(f);

inverse transforming the resultant spectrum D(f) to obtain the resultant signal D(k).

Each of the virtual beams B(i), i=1, 2, . . . , $N_B$ has an associated frequency range $$R(i)=[c_i,d_i]$$

and operates on a corresponding subset $S_i$ of the input spectra $X_j(f)$, j=1, 2, . . . , $N_M$. (To say that A is a subset of B does not exclude the possibility that subset A may equal set B.) The processor 207 may window each of the spectra of the subset $S_i$ with a window function $W_i(f)$ corresponding to the frequency range R(i) to obtain windowed spectra, and, operate on the windowed spectra with the beam B(i) to obtain spectrum V(i). The window function $W_i$ may equal one inside the range R(i) and the value zero outside the range R(i). Alternatively, the window function $W_i$ may smoothly transition to zero in neighborhoods of boundary frequencies $c_i$ and $d_i$.

The union of the ranges R(1), R(2), . . . , R($N_B$) may cover the range of audio frequencies, or, at least the range of frequencies occurring in speech.

The ranges R(1), R(2), . . . , R($N_B$) include a first subset of ranges that are above a certain frequency $f_{TR}$ and a second subset of ranges that are below the frequency $f_{TR}$. In one embodiment, the frequency $f_{TR}$ may be approximately 550 Hz.

Each of the virtual beams B(i) that corresponds to a frequency range R(i) below the frequency $f_{TR}$ may be a superdirective beam of order L(i) formed from L(i)+1 of the input spectra $X_j(f)$, j=1, 2, . . . , $N_M$, where L(i) is an integer greater than or equal to one. The L(i)+1 spectra may correspond to L(i)+1 microphones of the circular array that are aligned (or approximately aligned) in the target direction.

Furthermore, each of the virtual beams B(i) that corresponds to a frequency range R(i) above the frequency $f_{TR}$ may have the form of a delay-and-sum beam. The delay-and-sum parameters of the virtual beam B(i) may be designed by beam forming design software. The beam forming design software may be conventional software known to those skilled in the art of beam forming. For example, the beam forming design software may be software that is available as part of MATLAB®.

Figure 8:
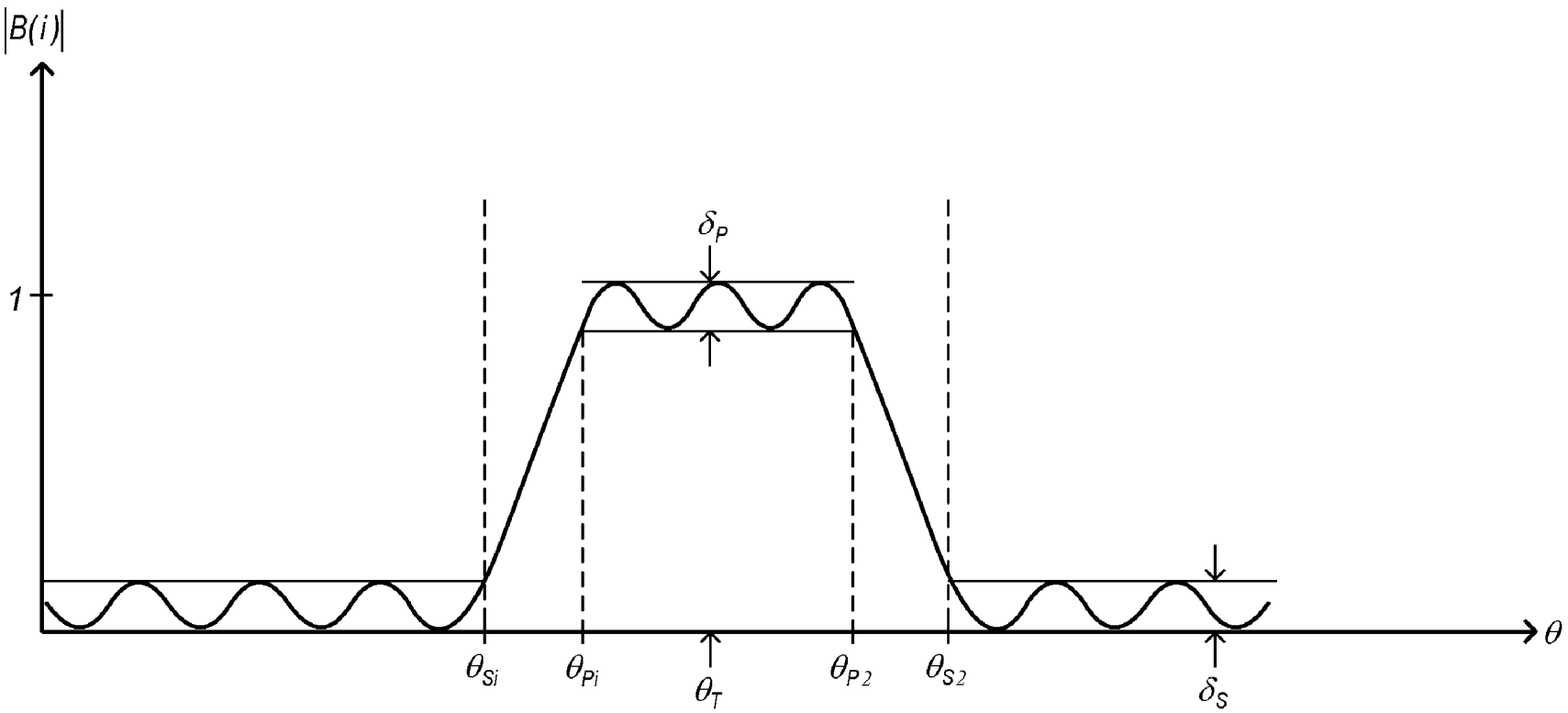
FIG. 8 illustrates an example of design parameters associated with the design of a beam B(i).

The beam forming design software may be directed to design an optimal delay-and-sum beam for beam B(i) at some frequency $f_i$ (e.g., the midpoint frequency) in the frequency range R(i) given the geometry of the circular array and beam constraints such as passband ripple $\delta_p$, stopband ripple $\delta_s$, passband edges $\theta_{P1}$ and $\theta_{P2}$, first stopband edge $\theta_{S1}$ and second stopband edge $\theta_{S2}$ as suggested by FIG. 8.

The beams corresponding to frequency ranges above the frequency $f_{TR}$ are referred to herein as "high-end beams". The beams corresponding to frequency ranges below the frequency $f_{TR}$ are referred to herein as "low-end beams". The virtual beams B(1), B(2), . . . , B($N_B$) may include one or more low-end beams and one or more high-end beams.

In some embodiments, the beam constraints may be the same for all high-end beams B(i). The passband edges $\theta_{P1}$ and $\theta_{P2}$ may be selected so as to define an angular sector of size 360/$N_M$ degrees (or approximately this size). The passband may be centered on the target direction $\theta_T$.

The high end frequency ranges R(i) may be an ordered succession of ranges that cover the frequencies from $f_{TR}$ up to a certain maximum frequency (e.g., the upper limit of audio frequencies, or, the upper limit of voice frequencies).

The delay-and-sum parameters for each high-end beam and the parameters for each low-end beam may be designed at a design facility and stored into memory 209 prior to operation of the speakerphone.

Since the microphone array is symmetric with respect to rotation through any multiple of 360/$N_M$ degrees, in one set of embodiments, the set of parameters designed for one target direction may be used for any of the $N_M$ target directions given by $$k(360/N_M), k=0, 1, 2, \ldots, N_M-1,$$

by applying an appropriate circular shift when accessing the parameters from memory.

In one embodiment, the frequency $f_{TR}$ is 550 Hz,

R(1)=R(2)=[0,550 Hz],

L(1)=L(2)=2, and low-end beam B(1) operates on three of the spectra $X_j(f)$, j=1, 2, . . . , $N_M$, and low-end beam B(2) operates on a different three of the spectra $X_j(f)$, j=1, 2, . . . , $N_M$;

frequency ranges R(3), R(4), . . . , R($N_B$) are an ordered succession of ranges covering the frequencies from $f_{TR}$ up to a certain maximum frequency (e.g., the upper limit of audio frequencies, or, the upper limit of voice frequencies);

beams B(3), B(4), . . . , B($N_M$) are high-end beams designed as described above.

Figure 9:
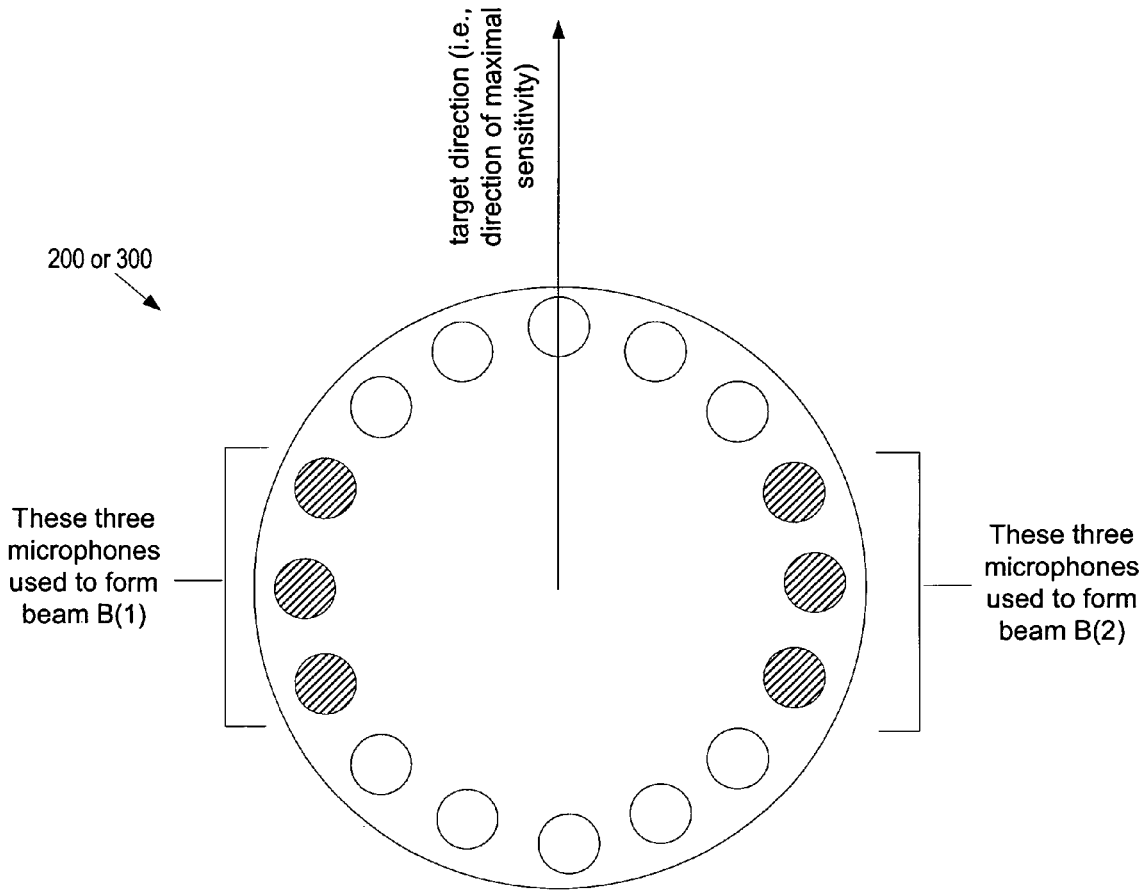
FIG. 9 illustrates two sets of three microphones aligned approximately in a target direction, each set being used to form a virtual beam.

FIG. 9 illustrates the three microphones (and thus, the three spectra) used by each of beams B(1) and B(2), relative to the target direction.

Figure 10:
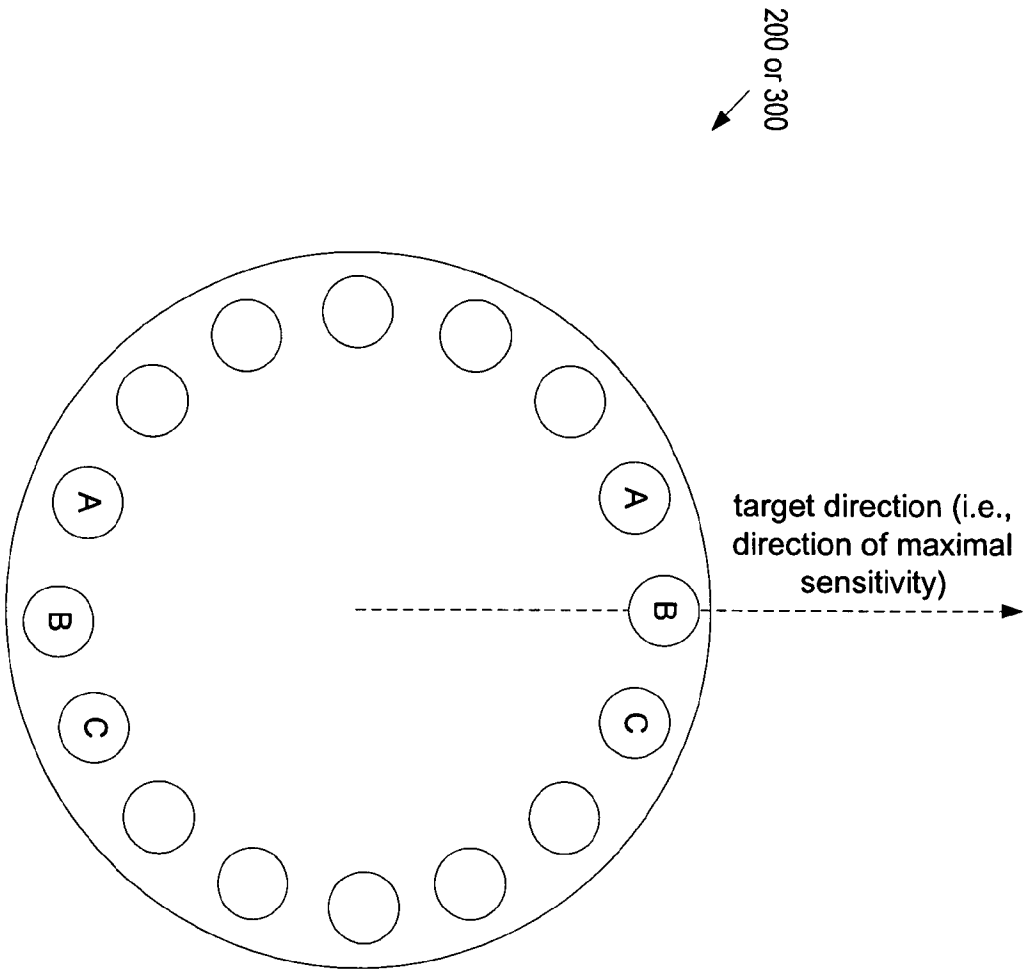
FIG. 10 illustrates three sets of two microphones aligned in a target direction, each set being used to form a virtual beam.

In another embodiment, the virtual beams B(1), B(2), . . . , B($N_B$) may include a set of low-end beams of first order. FIG. 10 illustrates an example of three low-end beams of first order. Each of the three low-end beams may be formed using a pair of the input spectra $X_j(f)$, j=1, 2, . . . , $N_M$. For example, beam B(1) may be formed from the input spectra corresponding to the two "A" microphones. Beam B(2) may be formed form the input spectra corresponding to the two "B" microphones. Beam B(3) may be formed form the input spectra corresponding to the two "C" microphones.

Figure 11:
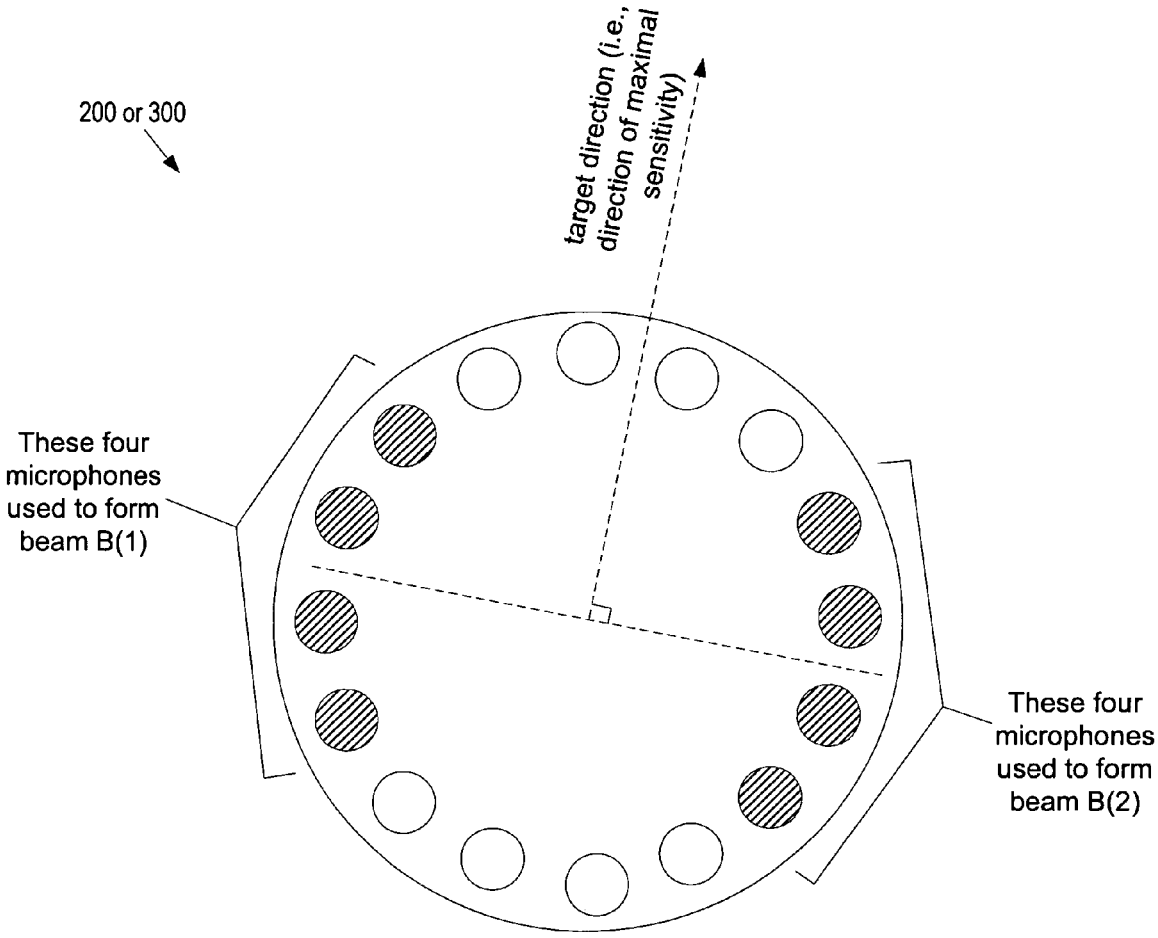
FIG. 11 illustrates two sets of four microphones aligned in a target direction, each set being used to form a virtual beam.

In yet another embodiment, the virtual beams B(1), B(2), . . . , B($N_B$) may include a set of low-end beams of third order. FIG. 11 illustrates an example of two low-end beams of third order. Each of the two low-end beams may be formed using a set of four input spectra corresponding to four consecutive microphone channels that are approximately aligned in the target direction.

In one embodiment, the low order beams may include: second order beams (e.g., a pair of second order beams as suggested in FIG. 9), each second order beam being associated with the range of frequencies less than $f_1$, where $f_1$ is less than $f_{TR}$; and third order beams (e.g., a pair of third order beams as suggested in FIG. 11), each third order beam being associated with the range of frequencies from $f_1$ to $f_{TR}$. For example, $f_1$ may equal approximately 250 Hz.

Figure 12A:
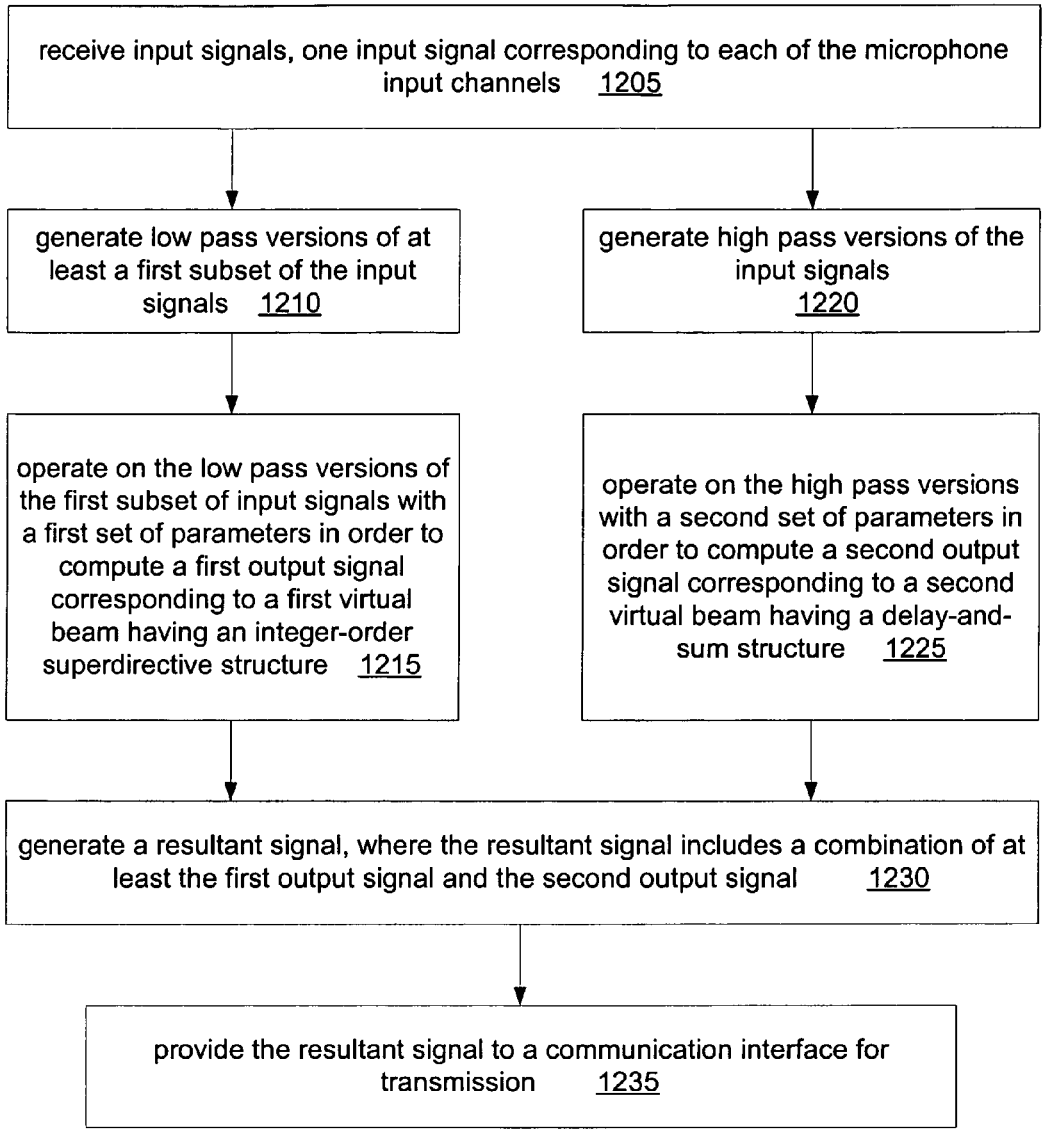
FIG. 12A illustrates one set of embodiments of a method for forming a highly directed beam using at least an integer-order superdirective beam and a delay-and-sum beam.

In one set of embodiments, a method for generating a highly directed beam may involve the following actions, as illustrated in FIG. 12A.

At 1205, input signals may be received from an array of microphones, one input signal from each of the microphones. The input signals may be digitized and stored in an input buffer.

At 1210, low pass versions of at least a first subset of the input signals may be generated. Transition frequency $f_{TR}$ may be the cutoff frequency for the low pass versions. The first subset of the input signals may correspond to a first subset of the microphones that are at least partially aligned in a target direction. (See FIGS. 9-11 for various examples in the case of a circular array.)

At 1215, the low pass versions of the first subset of input signals are operated on with a first set of parameters in order to compute a first output signal corresponding to a first virtual beam having an integer-order superdirective structure. The number of microphones in the first subset is one more than the integer order of the first virtual beam.

At 1220, high pass versions of the input signals are generated. Again, the transition frequency $f_{TR}$ may be the cutoff frequency for the high pass versions.

At 1225, the high pass versions are operated on with a second set of parameters in order to compute a second output signal corresponding to a second virtual beam having a delay-and-sum structure. The second set of parameters may be configured so as to direct the second virtual beam in the target direction.

The second set of parameters may be derived from a combination of parameter sets corresponding to a number of band-specific virtual beams. For example, in one embodiment, the second set of parameters is derived from a combination of the parameter sets corresponding to the high-end beams of delay-and-sum form discussed above. Let $N_H$ denote the number of high-end beams. As discussed above, beam design software may be employed to compute a set of parameters P(i) for a high-end delay-and-sum beam B(i) at some frequency $f_i$ in region R(i). The set P(i) may include $N_M$ complex coefficients denoted P(i,j), j=1, 2, . . . , $N_M$, i.e., one for each microphone. The second set Q of parameters may be generated from the parameter sets P(i), i=1, 2, . . . , $N_H$ according to the relation:

$$Q(j) = \sum_{i=1}^{N_H} P(i, j)U(i, j),$$

j=1, 2, . . . , $N_M$, where U(i,j) is a weighting function that weights the parameters of set P(i), corresponding to frequency $f_i$, most heavily at microphone #i and successively less heavily at microphones away from microphone #i. Other schemes for combining the multiple parameter sets are also contemplated.

At 1230, a resultant signal is generated, where the resultant signal includes a combination of at least the first output signal and the second output signal. The combination may be a linear combination or other type of combination. In one embodiment, the combination is a straight sum (with no weighting).

At 1235, the resultant signal may be provided to a communication interface for transmission to one or more remote destinations.

The action of generating low pass versions of at least a first subset of the input signals may include generating low pass versions of one or more additional subsets of the input signals distinct from the first subset. Correspondingly, the method may further involve operating on the additional subsets (of low pass versions) with corresponding additional virtual beams of integer-order superdirective structure. (There is no requirement that all the superdirective beams must have the same integer order.) Thus, the combination (used to generate the resultant signal) also includes the output signals of the additional virtual beams.

The method may also involve accessing an array of parameters from a memory, and applying a circular shift to the array of parameters to obtain the second set of parameters, where an amount of the shift corresponds to the desired target direction.

It is noted that actions 1210 through 1230 may be performed in the time domain, in the frequency domain, or partly in the time domain and partly in the frequency domain. For example, 1210 may be implemented by time-domain filtering or by windowing in the spectral domain. As another example, 1225 may be performed by weighting, delaying and adding time-domain functions, or, by weighting, adjusting and adding spectra. In light of the teachings given herein, one skilled in the art will not fail to understand how to implement each individual action in the time domain or in the frequency domain.

Figure 12B:
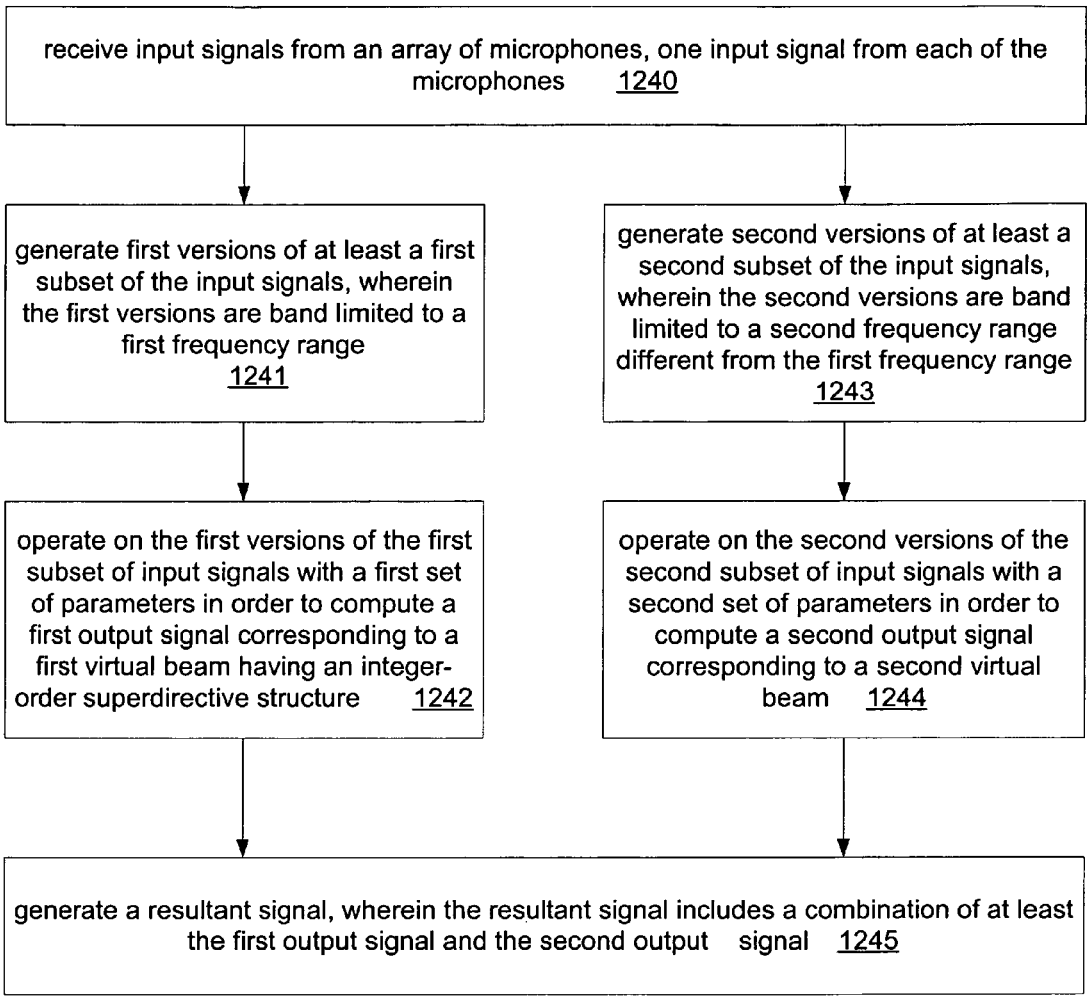
FIG. 12B illustrates one set of embodiments of a method for forming a highly directed beam using at least a first virtual beam and a second virtual beam in different frequency ranges.

In another set of embodiments, a method for generating a highly directed beam may involve the following actions, as illustrated in FIG. 12B.

At 1240, input signals are received from an array of microphones, one input signal from each of the microphones.

At 1241, first versions of at least a first subset of the input signals are generated, wherein the first versions are band limited to a first frequency range.

At 1242, the first versions of the first subset of input signals are operated on with a first set of parameters in order to compute a first output signal corresponding to a first virtual beam having an integer-order superdirective structure.

At 1243, second versions of at least a second subset of the input signals are generated, wherein the second versions are band limited to a second frequency range different from the first frequency range.

At 1244, the second versions of the second subset of input signals are operated on with a second set of parameters in order to compute a second output signal corresponding to a second virtual beam.

At 1245, a resultant signal is generated, wherein the resultant signal includes a combination of at least the first output signal and the second output signal.

The second virtual beam may be a beam having a delay-and-sum structure or an integer order superdirective structure, e.g., with integer order different from the integer order of the first virtual beam.

The first subset of the input signals may correspond to a first subset of the microphones which are at least partially aligned in a target direction. Furthermore, the second set of parameters may be configured so as to direct the second virtual beam in the target direction.

Additional integer-order superdirective beams and/or delay-and-sum beams may be applied to corresponding subsets of band-limited versions of the input signals, and the corresponding outputs (from the additional beams) may be combined into the resultant signal.

In another set of embodiments, a system may include a set of microphones, a memory and a processor, e.g., as suggested variously above in conjunction with FIGS. 1 and 7. The memory may be configured to store program instructions. The processor may be configured to read and execute the program instructions from the memory. The program instructions may be executable to implement:

(a) receiving input signals, one input signal corresponding to each of the microphones;

(b) generating first versions of at least a first subset of the input signals, wherein the first versions are band limited to a first frequency range;

(c) operating on the first versions of the first subset of input signals with a first set of parameters in order to compute a first output signal corresponding to a first virtual beam having an integer-order superdirective structure;

(d) generating second versions of at least a second subset of the input signals, wherein the second versions are band limited to a second frequency range different from the first frequency range;

(e) operating on the second versions of the second subset of input signals with a second set of parameters in order to compute a second output signal corresponding to a second virtual beam;

(f) generating a resultant signal, wherein the resultant signal includes a combination of at least the first output signal and the second output signal.

The second virtual beam may be a beam having a delay-and-sum structure or an integer order superdirective structure, e.g., with integer order different from the integer order of the first virtual beam.

The first subset of the input signals may correspond to a first subset of the microphones which are at least partially aligned in a target direction. Furthermore, the second set of parameters may be configured so as to direct the second virtual beam in the target direction.

Additional integer-order superdirective beams and/or delay-and-sum beams may be applied to corresponding subsets of band-limited versions of the input signals, and the corresponding outputs (from the additional beams) may be combined into the resultant signal.

The program instructions may be further configured to direct the processor to provide the resultant signal to a communication interface (e.g., one of communication interfaces 211) for transmission to one or more remote devices.

The set of microphones may be arranged on a circle. Other array topologies are contemplated. For example, the microphones may be arranged on an ellipse, a square, or a rectangle. In some embodiments, the microphones may be arranged on a grid, e.g., a rectangular grid, a hexagonal grid, etc.

Figure 12C:
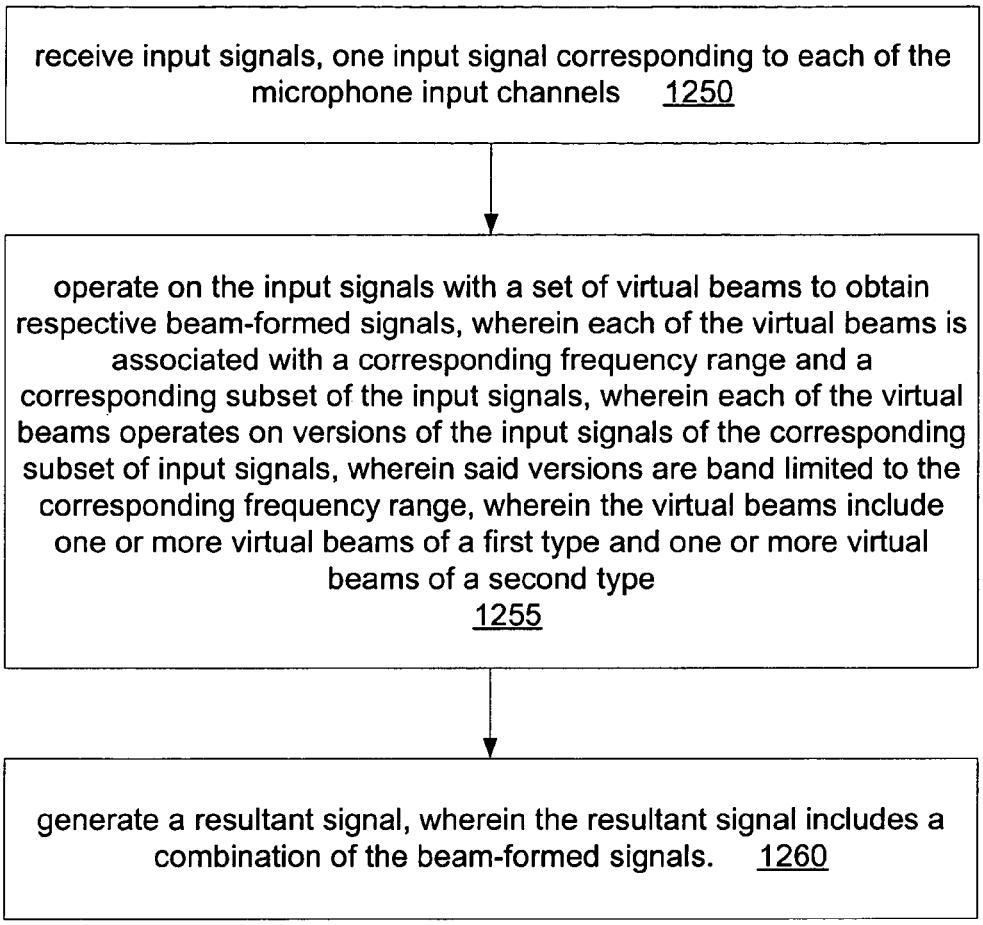
FIG. 12C illustrates one set of embodiments of a method for forming a highly directed beam using one or more virtual beams of a first type and one or more virtual beams of a second type.

In yet another set of embodiments, a method for generating a highly directed beam may include the following actions, as illustrated in FIG. 12C.

At 1250, input signals may be received from an array of microphones, one input signal from each of the microphones.

At 1255, the input signals may be operated on with a set of virtual beams to obtain respective beam-formed signals, where each of the virtual beams is associated with a corresponding frequency range and a corresponding subset of the input signals, where each of the virtual beams operates on versions of the input signals of the corresponding subset of input signals, where said versions are band limited to the corresponding frequency range, where the virtual beams include one or more virtual beams of a first type and one or more virtual beams of a second type.

The first type and the second type may correspond to: different mathematical expressions describing how the input signals are to be combined; different beam design methodologies; different theoretical approaches to beam forming, etc.

The one or more beams of the first type may be integer-order superdirective beams. Furthermore, the one or more beams of the second type may be delay-and-sum beams.

At 1260, a resultant signal may be generated, where the resultant signal includes a combination of the beam-formed signals.

The methods illustrated in FIGS. 12A-C may be implemented by one or more processors under the control of program instructions, by dedicated (analog and/or digital) circuitry, or, by a combination of one or more processors and dedicated circuitry. For example, any or all of these methods may be implemented by one or more processors in a speakerphone (e.g., speakerphone 200 or speakerphone 300).

Figure 13:
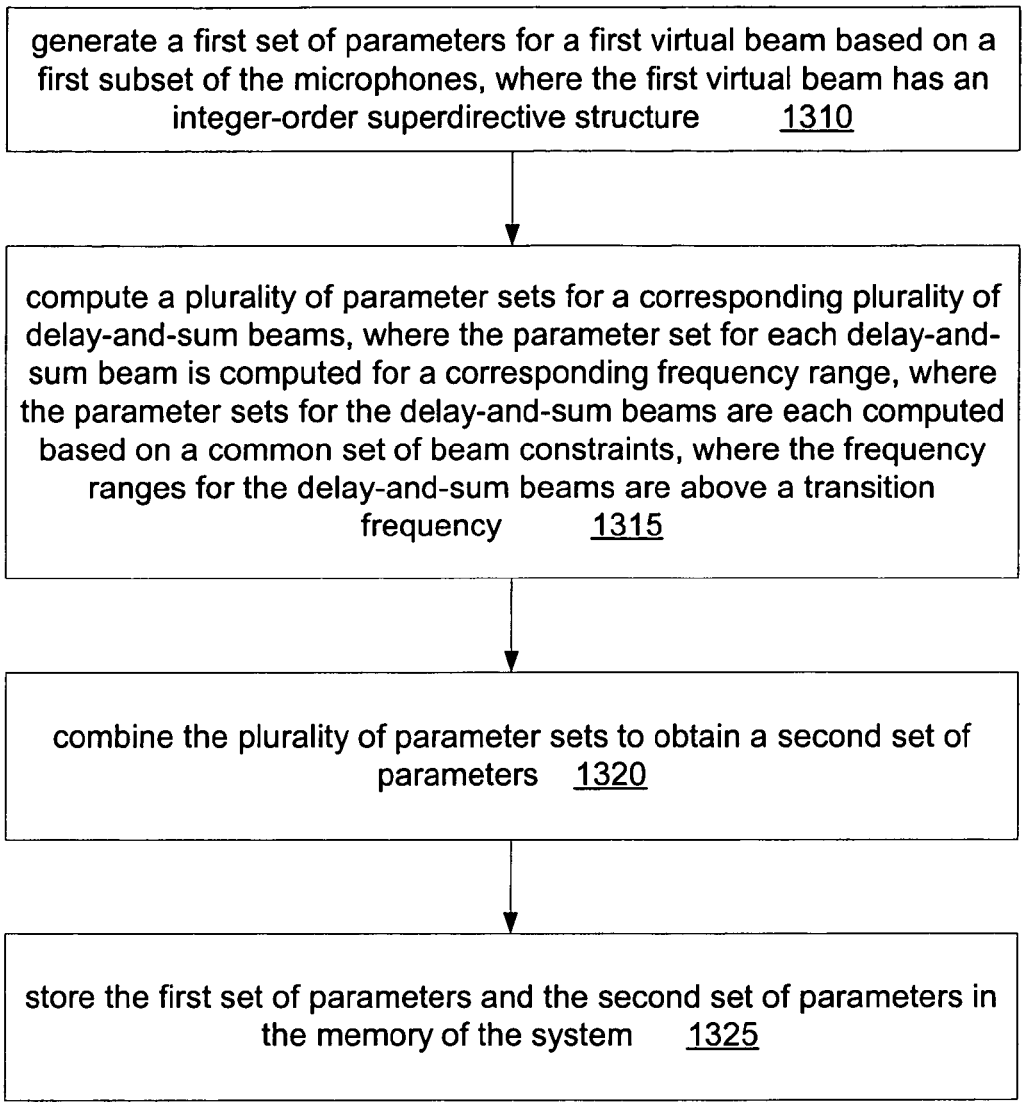
FIG. 13 illustrates one set of embodiments of a method for configured a system having an array of microphones, a processor and a method.

In yet another set of embodiments, a method for configuring a target system (i.e., a system including a processor, a memory and one or more processors) may involve the following actions, as illustrated in FIG. 13. The method may be implemented by executing program instructions on a computer system which is coupled to the target system.

At 1310, a first set of parameters may be generated for a first virtual beam based on a first subset of the microphones, where the first virtual beam has an integer-order superdirective structure.

At 1315, a plurality of parameter sets may be computed for a corresponding plurality of delay-and-sum beams, where the parameter set for each delay-and-sum beam is computed for a corresponding frequency, where the parameter sets for the delay-and-sum beams are computed based on a common set of beam constraints. The frequencies for the delay-and-sum beams may be above a transition frequency.

At 1320, the plurality of parameter sets may be combined to obtain a second set of parameters, e.g., as described above.

At 1325, the first set of parameters and the second set of parameters may be stored in the memory of the target system.

The delay-and-sum beams may be designed using beam forming design software. Each of the delay-and-sum beams may be designed subject to the same (or similar) set of beam constraints. For example, each of the delay-and-sum beams may be constrained to have the same pass band width (i.e., main lobe width).

The target system being configured may be a device such as a speakerphone, a videoconferencing system, a surveillance device, a video camera, etc.

One measure of the quality of a virtual beam formed from a microphone array is directivity index (DI). Directivity index indicates the amount of rejection of signal off axis from the desired signal. Virtual beams formed from endfire microphone arrays ("endfire beams") have an advantage over beams formed from broadside arrays ("broadside beams") in that the endfire beams have constant DI over all frequencies as long as the wavelength is greater than the microphone array spacing. (Broadside beams have increasingly lower DI at lower frequencies.) For endfire arrays, however, as the frequency goes down the signal level goes down by (6 dB per octave)×(endfire beam order) and therefore the gain required to maintain a flat response goes up, requiring higher signal-to-noise ratio to obtain a usable result.

A high DI at low frequencies is important because room reverberations, which people hear as "that hollow sound", are predominantly at low frequencies. The higher the "order" of an endfire microphone array the higher the potential DI value.

Calibration to Correct for Acoustic Shadowing

The performance of a speakerphone (such as speakerphone 200 or speakerphone 300) using an array of microphones may be constrained by:

(1) the accuracy of knowledge of the 3 dimensional position of each microphone in the array;

(2) the accuracy of knowledge of the magnitude and phase response of each microphone;

(3) the signal-to-noise ratio (S/N) of the signal arriving at each microphone; and (4) the minimum acceptable signal-to-noise (S/N) ratio (as a function of frequency) determined by the human auditory system.

(1) Prior to use of the speakerphone (e.g., during the manufacturing process), the position of each microphone in the speakerphone may be measured by placing the speakerphone in a test chamber. The test chamber includes a set of speakers at known positions. The 3D position of each microphone in the speakerphone may be determined by:

asserting a known signal from each speaker;

capturing the response from the microphone;

performing cross-correlations to determine the propagation time of the known signal from each speaker to the microphone;

computing the propagation distance between each speaker and the microphone from the corresponding propagation times;

computing the 3D position of the microphone from the propagation distances and the known positions of the speakers.

It is noted that the phase of the A/D clock and/or the phase of D/A clock may be adjusted as described above to obtain more accurate estimates of the propagation times. The microphone position data may be stored in non-volatile memory in each speakerphone.

(2) There are two parts to having an accurate knowledge of the response of the microphones in the array. The first part is an accurate measurement of the baseline response of each microphone in the array during manufacture (or prior to distribution to customer). The first part is discussed below. The second part is adjusting the response of each microphone for variations that may occur over time as the product is used. The second part is discussed in detail above.

Especially at higher frequencies each microphone will have a different transfer function due to asymmetries in the speakerphone structure or in the microphone pod. The response of each microphone in the speakerphone may be measured as follows. The speakerphone is placed in a test chamber at a base position with a predetermined orientation. The test chamber includes a movable speaker (or set of speakers at fixed positions). The speaker is placed at a first position in the test chamber. A calibration controller asserts a noise burst through the speaker. The calibration controller read and stores the signal $X_j(k)$ captured by the microphone $M_j$, j=1, 2, . . . , $N_M$, in the speakerphone in response to the noise burst. The speaker is moved to a new position, and the noise broadcast and data capture is repeated. The noise broadcast and data capture are repeated for a set of speaker positions. For example, in one embodiment, the set of speaker positions may explore the circle in space given by:

radius equal to 5 feet relative to an origin at the center of the microphone array;

azimuth angle in the range from zero to 360 degrees;

elevation angle equal to 15 degrees above the plane of the microphone array.

In another embodiment, the set of speaker positions may explore a region in space given by:

radius in the range form 1.5 feet to 20 feet.

azimuth angle in the range from zero to 360 degrees;

elevation angle in the range from zero to 90 degrees.

A wide variety of embodiments are contemplated for the region of space sampled by the set of speaker positions.

A second speakerphone, having the same physical structure as the first speakerphone, is placed in the test chamber at the base position with the predetermined orientation. The second speakerphone has ideal microphones $G_j$, j=1, 2, . . . , $N_M$, mounted in the slots where the first speakerphone has less than ideal microphones $M_j$. The ideal microphones are "golden" microphones having flat frequency response. The same series of speaker positions are explored as with the first speakerphone. At each speaker position the same noise burst is asserted and the response $X_j^G(k)$ from each of the golden microphones of the second speakerphone is captured and stored.

For each microphone channel j and each speaker position, the calibration controller may compute an estimate for the transfer function of the microphone $M_j$, j=1, 2, . . . , $N_M$, according to the expression:

$$H_j^{mic}(\omega)=X_j(\omega)/X_j^G(\omega).$$

The division by spectrum $X_j^G(\omega)$ cancels the acoustic effects due to the test chamber and the speakerphone structure. These microphone transfer functions are stored into non-volatile memory of the first speakerphone, e.g., in memory 209.

In practice, it may be more efficient to gather the golden microphone data from the second speakerphone first, and then, gather data from the first speakerphone, so that the microphone transfer functions $H_j^{mic}(\omega)$ for each microphone channel and each speaker position may be immediately loaded into the first speakerphone before detaching the first speakerphone from the calibration controller.

In one embodiment, the first speakerphone may itself include software to compute the microphone transfer functions $H_j^{mic}(\omega)$ for each microphone and each speaker position. In this case, the calibration controller may download the golden response data to the first speakerphone so that the processor 207 of the speakerphone may compute the microphone transfer functions.

In some embodiments, the test chamber may include a platform that can be rotated in the horizontal plane. The speakerphone may be placed on the platform with the center of the microphone array coinciding with the axis of the rotation of the platform. The platform may be rotated instead of attempting to change the azimuth angle of the speaker. Thus, the speaker may only require freedom of motion within a single plane passing through the axis of rotation of the platform.

When the speakerphone is being used to conduct a live conversation, the processor 207 may capture signals $X_j(k)$ from the microphone input channels, j=1, 2, . . . , $N_M$, and operate on the signals $X_j(k)$ with one or more virtual beams as described above. The virtual beams are pointed in a target direction (or at a target position in space), e.g., at an acoustic source such as a current talker. The beam design software may have designed the virtual beams under the assumption that the microphones are ideal omnidirectional microphones having flat spectral response. In order to compensate for the fact that the microphones $M_j$, j=1, 2, . . . , $N_M$, are not ideal omnidirectional microphones, the processor 207 may access the microphone transfer functions $H_j^{mic}$ corresponding to the target direction (or the target position in space) and multiply the spectra $X_j($ 7$)$ of the received signals by the inverses $1/H_j^{mic}(\omega)$ of the microphone transfer functions respectively:

$$X_j^{adj}(\omega)=X_j(\omega)/H_j^{mic}(\omega)$$

The adjusted spectra $X_j^{adj}(\omega)$ may then be supplied to the virtual beam computations.

At high frequencies, effects such as acoustic shadowing begin to show up, in part due to the asymmetries in the speakerphone surface structure. For example, since the keypad is on one side of the speakerphone's top surface, microphones near the keypad will experience a different shadowing pattern than microphones more distant from the keypad. In order to allow for the compensation of such effects, the following calibration process may be performed. A golden microphone may be positioned in the test chamber at a position and orientation that would be occupied by the microphone $M_1$ if the first speakerphone had been placed in the test chamber. The golden microphone is positioned and oriented without being part of a speakerphone (because the intent is to capture the acoustic response of just the test chamber.) The speaker of the test chamber is positioned at the first of the set of speaker positions (i.e., the same set of positions used above to calibrate the microphone transfer functions). The calibration controller asserts the noise burst, reads the signal $X_1^C(k)$ captured from microphone $M_1$ in response to the noise burst, and stores the signal $X_1^C(k)$. The noise burst and data capture is repeated for the golden microphone in each of the positions that would have been occupied if the first speakerphone had been placed in the test chamber. Next, the speaker is moved to a second of the set of speaker positions and the sequence of noise-burst-and-data-gathering over all microphone positions is performed. The sequence of noise-burst-and-data-gathering over all microphone positions is performed for each of the speaker positions. After having explored all speaker positions, the calibration controller may compute a shadowing transfer function $H_j^{SH}(\omega)$ for each microphone channel $j=1, 2, \ldots, N_M$, and for each speaker position, according to the expression:

$$H_j^{SH}(\omega)=X_j^G(\omega)/X_j^C(\omega).$$

The shadowing transfer functions may be stored in the memory of speakerphones prior to the distribution of the speakerphones to customers.

When a speakerphone is being used to conduct a live conversation, the processor 207 may capture signals $X_j(k)$ from the microphone input channels, $j=1, 2, \ldots, N_M$, and operate on the signals $X_j(k)$ with one or more virtual beams pointed in a target direction (or at a target position) as described variously above. In order to compensate for the fact that the microphones $M_j$, $j=1, 2, 3, \ldots, N_M$, are acoustically shadowed (by being incorporated as part of a speakerphone), the processor 207 may access the shadow transfer functions $H_j^{SH}(\omega)$ corresponding to the target direction (or target position in space) and multiply the spectra $X_j(\omega)$ of the received signals by the inverses $1/H_j^{SH}(\omega)$ of the shadowing transfer functions respectively:

$$X_j^{adj}(\omega)=X_j(\omega)/H_j^{SH}(\omega).$$

The adjusted spectra $X_j^{adj}(\omega)$ may then be supplied to the virtual beam computations for the one or more virtual beams.

In some embodiments, the processor 207 may compensate for both non-ideal microphones and acoustic shadowing by multiplying each received signal spectrum $X_j(\omega)$ by the inverse of the corresponding shadowing transfer function for the target direction (or position) and the inverse of the corresponding microphone transfer function for the target direction (or position):

$$X_j^{adj}(\omega) = \frac{X_j(\omega)}{H_j^{SH}(\omega)H_j^{mic}(\omega)}.$$

The adjusted spectra $X_j^{adj}(\omega)$ may then be supplied to the virtual beam computations for the one or more virtual beams.

In some embodiments, parameters for a number of ideal high-end beams as described above may be stored in a speakerphone. Each ideal high-end beam $B^{Id}(i)$ has an associated frequency range $R_i=[c_i,d_i]$ and may have been designed (e.g., as described above, using beam design software) assuming that: (a) the microphones are ideal omnidirectional microphones and (b) there is no acoustic shadowing. The ideal beam $B^{Id}(i)$ may be given by the expression:

$$IdealBeamOutput_i(\omega) = \sum_{j=1}^{N_B} C_j W_i(\omega) X_j(\omega) \exp(-i\omega d_j),$$

where the attenuation coefficients $C_j$ and the time delay values $d_j$ are values given by the beam design software, and $W_i$ is the spectral window function corresponding to frequency range $R_i$. The failure of assumption (a) may be compensated for by the speakerphone in real time operation as described above by multiplying by the inverses of the microphone transfer functions corresponding to the target direction (or target position). The failure of the assumption (b) may be compensated for by the speakerphone in real time operation as described above by applying the inverses of the shadowing transfer functions corresponding to the target direction (or target position). Thus, the corrected beam B(i) corresponding to ideal beam $B^{Id}(i)$ may conform to the expression:

$$CorrectedBeamOutput_i(\omega) = \sum_{j=1}^{N_B} C_j W_i(\omega) \frac{X_j(\omega)}{H_j^{SH}(\omega)H_j^{mic}(\omega)} \exp(-i\omega d_j).$$

In one embodiment, the complex value $z_{i,j}$ of the shadowing transfer function $H_j^{SH}(\omega)$ at the center frequency (or some other frequency) of the range $R_i$ may be used to simplify the above expression to:

$$CorrectedBeamOutput_i(\omega) = \sum_{j=1}^{N_B} C_j W_i(\omega) \frac{X_j(\omega)}{H_j^{mic}(\omega)} \exp(-i\omega d_j)/z_{i,j}.$$

A similar simplification may be achieved by replacing the microphone transfer function $H_j^{mic}(\omega)$ with its complex value at some frequency in the range $R_i$.

In one set of embodiments, a speakerphone may declare the failure of a microphone in response to detecting a discontinuity in the microphone transfer function as determined by a microphone calibration (e.g., an offline self calibration or live self calibration as described above) and a comparison to past history information for the microphone. Similarly, the failure of a speaker may be declared in response to detecting a discontinuity in one or more parameters of the speaker input-output model as determined by a speaker calibration (e.g., an offline self calibration or live self calibration as described above) and a comparison to past history information for the speaker. Similarly, a failure in any of the circuitry interfacing to the microphone or speaker may be detected.

At design time an analysis may be performed in order to predict the highest order end-fire array achievable independent of S/N issues based on the tolerances of the measured positions and microphone responses. As the order of an end-fire array is increased, its actual performance requires higher and higher precision of microphone position and microphone response. By having very high precision measurements of these factors it is possible to use higher order arrays with higher DI than previously achievable.

With a given maximum order array determined by tolerances, the required S/N of the system is considered, as that may also limit the maximum order and therefore maximum usable DI at each frequency.

The S/N requirements at each frequency may be optimized relative to the human auditory system.

An optimized beam forming solution that gives maximum DI at each frequency subject to the S/N requirements and array tolerance of the system may be implemented. For example, consider an nht array with the following formula:

$$X=g1*\text{mic}1(t-d1)-g2*\text{mic}2(t-d2)-\ldots gn*\text{mic}n(t-dn).$$

Various mathematical solving techniques such an iterative solution or a Kalman filter may be used to determine the required delays and gains needed to produce a solution optimized for S/N, response, tolerance, DI and the application.

For example, an array used to measure direction of arrival may need much less S/N allowing higher DI than an application used in voice communications. There may be different S/N requirements depending on the type of communication channel or compression algorithm applied to the data.

Cross Correlation Analysis to Fine Tune AEC Echo Analysis.

Figure 14:
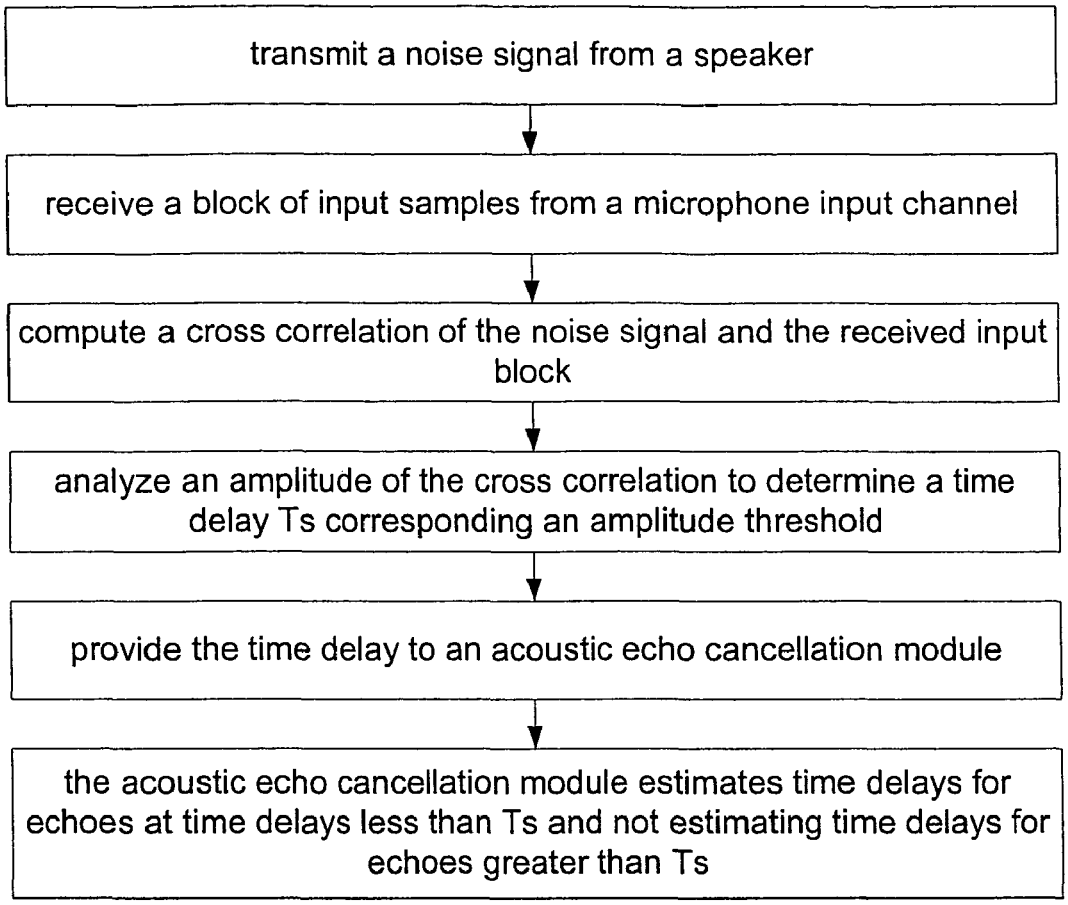
FIG. 14 illustrates one embodiment of a method for enhancing the performance of acoustic echo cancellation.

In one set of embodiments, the processor 207 may be programmed, e.g., as illustrated in FIG. 14, to perform a cross correlation to determine the maximum delay time for significant echoes in the current environment, and, to direct the automatic echo cancellation (AEC) module to concentrate its efforts on significant early echoes, instead of wasting its effort trying to detect weak echoes buried in the noise.

The processor 207 may wait until some time when the environment is likely to be relatively quiet (e.g., in the middle of the night, or, early morning). If the environment is sufficiently quiet, the processor 207 may execute a tuning procedure as follows.

The processor 207 may wait for a sufficiently long period of silence, then transmit a noise signal.

The noise signal may be a maximum length sequence (in order to allow the longest calibration signal with the least possibility of auto-correlation). However, effectively the same result can be obtained by repeating the measurement with different (non-maximum length sequence) noise bursts and then averaging the results. The noise bursts can further be optimized by first determining the spectral characteristics of the background noise in the room and then designing a noise burst that is optimally shaped (e.g., in the frequency domain) to be discemable above that particular ambient noise environment.

The processor 207 may capture a block of input samples from an input channel in response to the noise signal transmission.

The processor may perform a cross correlation between the transmitted noise signal and the block of input samples.

The processor may analyze the amplitude of the cross correlation function to determine a time delay $\tau_0$ associated with the direct path signal from the speaker to microphone.

The processor may analyze the amplitude of the cross correlation function to determine the time delay ($T_s$) at which the amplitude dips below a threshold $A_{TH}$ and stays below that threshold. For example, the threshold $A_{TH}$ may be the RT-60 threshold relative to the peak corresponding to the direct path signal.

In one embodiment, $T_s$ may be determined by searching the cross correlation amplitude function in the direction of decreasing time delay, starting from the maximum value of time delay computed.

The time delay $T_s$ may be provided to the AEC module so that the AEC module can concentrate its effort on analyzing echoes (i.e., reflections) at time delays less than or equal to $T_s$. Thus, the AEC module doesn't waste its computational effort trying to detect the weak echoes at time delays greater than $T_s$.

It is of particular interest to note that $T_s$ attains its maximum value $T_s^{max}$ for any given room when the room is empty. Thus, we can know that any particular measurement of $T_s$ will be less than or equal to $T_s^{max}$. If this condition is violated by moving the unit from one room to another, then we will know that up front, because the speakerphone will typically have to be powered down while it is being moved.

Tracking Talkers with Directed Beams

Figure 15A:
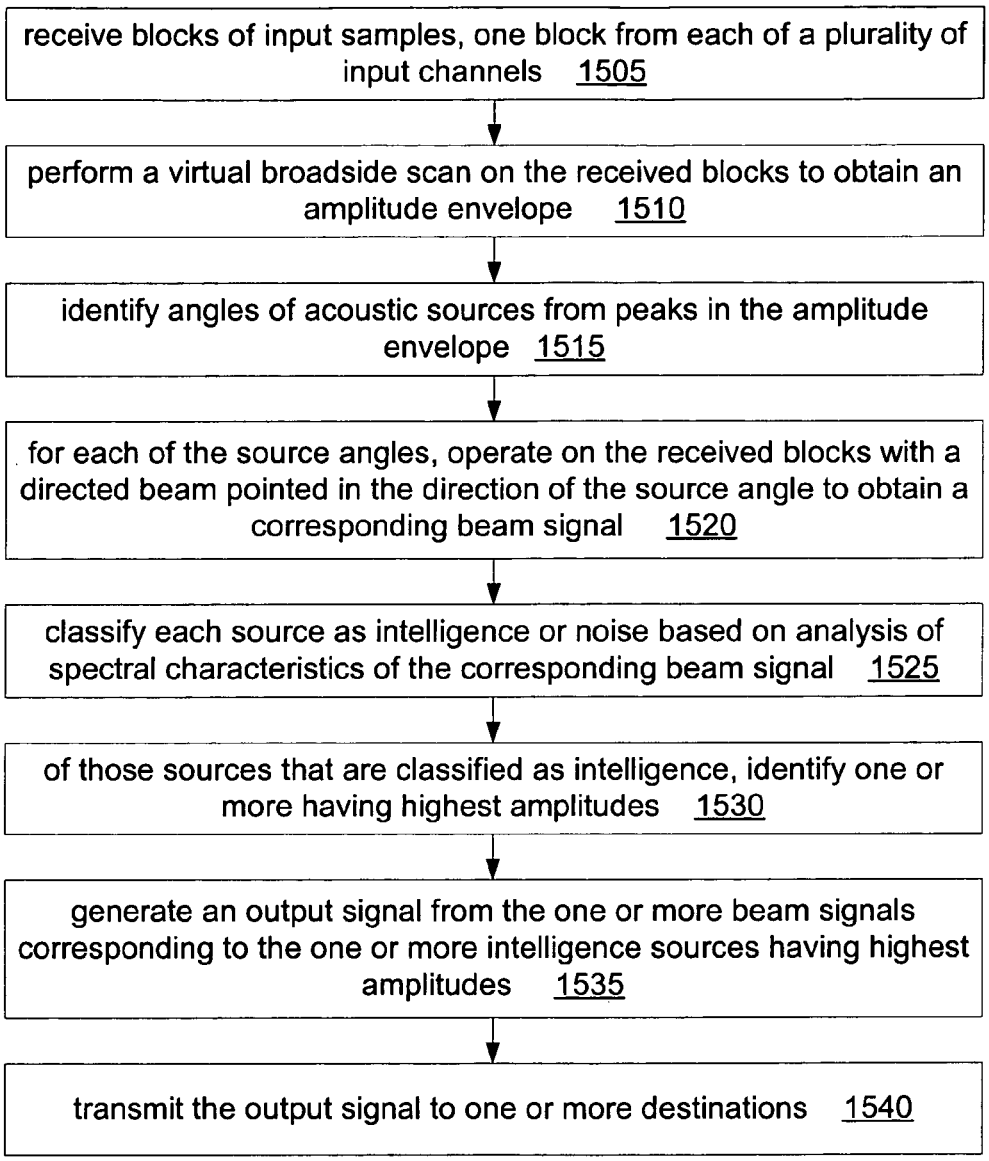
FIG. 15A illustrates one embodiment of a method for tracking one or more talkers with highly directed beams.

In one set of embodiments, the speakerphone may be programmed to implement the method embodiment illustrated in FIG. 15A. This method embodiment may serve to capture the voice signals of one or more talkers (e.g., simultaneous talkers) using a virtual broadside scan and one or more directed beams.

Figure 15B:
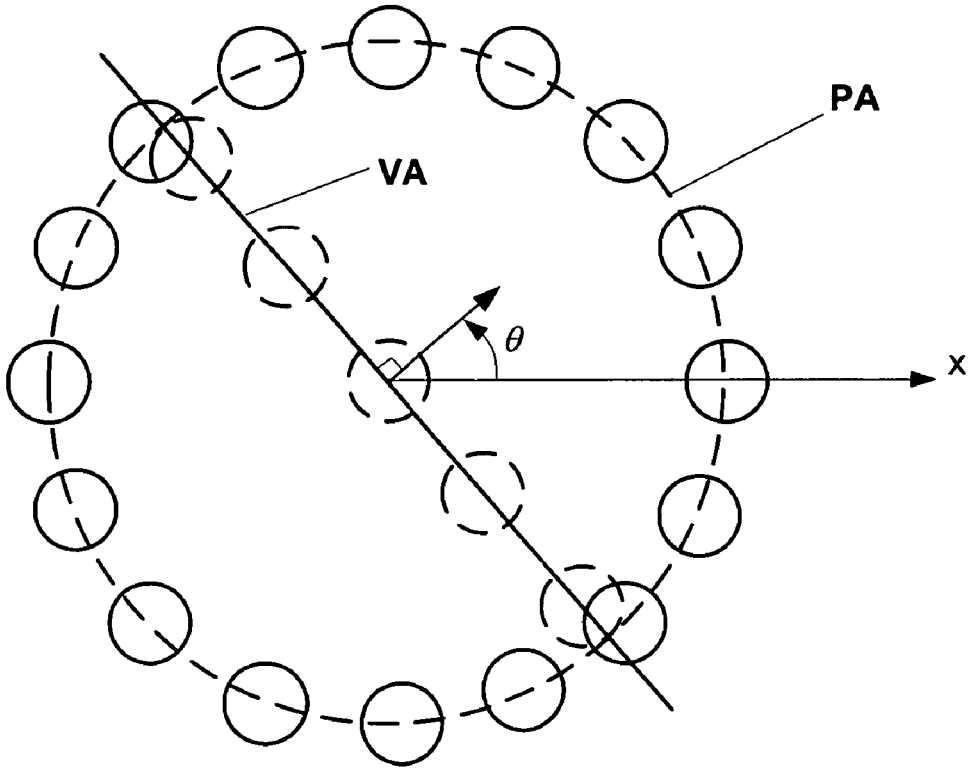
FIG. 15B illustrates a virtual broadside array formed from a circular array of microphones.

This set of embodiments assumes an array of microphones, e.g., a circular array of microphones as illustrated in FIG. 15B.

At 1505, processor 207 receives a block of input samples from each of the input channels. (Each input channel corresponds to one of the microphones.)

At 1510, the processor 207 operates on the received blocks to scan a virtual broadside array through a set of angles spanning the circle to obtain an amplitude envelope describing amplitude versus angle. For example, in FIG. 15B, imagine the angle θ of the virtual linear array VA sweeping through 360 degrees (or 180 degrees). In some embodiments, the virtual linear arrays at the various angles may be generated by application of the Davies Transformation.

At 1515, the processor 207 analyzes the amplitude envelope to detect angular positions of sources of acoustic power.

As indicated at 1520, for each source angle, the processor 207 operates on the received blocks using a directed beam (e.g., a highly directed beam) pointed in the direction defined by the source angle to obtain a corresponding beam signal. The beam signal is a high quality representation of the signal emitted by the source at that source angle.

Any of various known techniques (or combinations thereof) may be used to construct the directed beam (or beams).

In one embodiment, the directed beam may be a hybrid beam as described above.

Alternatively, the directed beam may be adaptively constructed, based on the environmental conditions (e.g., the ambient noise level) and the kind of signal source being tracked (e.g., if it is determined from the spectrum of the signal that it is most likely a fan, then a different set of beam-forming coefficients may be used in order to more effectively isolate that particular audio source from the rest of the environmental background noise).

As indicated at 1525, for each source angle, the processor 207 may examine the spectrum of the corresponding beam signal for consistency with speech, and, classify the source angle as either:

"corresponding to speech (or, at least, corresponding to intelligence)", or "corresponding to noise".

As indicated at 1530, of those sources that have been classified as intelligence, the processor may identify one or more sources whose corresponding beam signals have the highest energies (or average amplitudes). The angles corresponding to these intelligence sources having highest energies are referred to below as "loudest talker angles".

At 1535, the processor may generate an output signal from the one or more beam signals captured by the one or more directed beams corresponding to the one or more loudest talker angles. In the case where only one loudest talker angle is identified, the processor may simply provide the corresponding beam signal as the output signal. In the case where a plurality of loudest talker angles are identified, the processor may combine (e.g., add, or, form a linear combination of) the beam signals corresponding to the loudest talker angles to obtain the output signal.

At 1540, the output signal may be transmitted to one or more remote devices, e.g., to one or more remote speakerphones through one or more of the communication interfaces 211.

A remote speakerphone may receive the output signal and provide the output signal to a speaker. Because the output signal is generated from the one or more beam signals corresponding to the one or more loudest talker angles; the remote participants are able to hear a quality representation of the speech (or other sounds) generated by the local participants, even in the situation where more than one local participant is talking at the same time, and even when there are interfering noise sources present in the local environment.

The processor may repeat operations 1505 through 1540 (or some subset of these operations) in order to track talkers as they move, to add new directed beams for persons that start talking, and to drop the directed beams for persons that have gone silent.

The next round of input and analysis may be accelerated by using the loudest talker angles determined in the current round of input and analysis.

The result of the broadside scan is an amplitude envelope. The amplitude envelope may be interpreted as a sum of angularly shifted and scaled versions of the response pattern of the virtual broadside array. If the angular separation between two sources equals the angular position of a sidelobe in the response pattern, the two shifted and scaled versions of the response may have sidelobes that superimpose. To avoid detecting such superimposed sidelobes as source peaks, the processor may analyze the amplitude envelope as follows.

(a) Estimate the angular position $\theta_P$ of a peak P (e.g., the peak of highest amplitude) in the amplitude envelope.

(b) Construct a shifted and scaled version $V_P$ of the virtual broadside response pattern, corresponding to the peak P, using the angular position $\theta_P$ and the amplitude of the peak P.

(c) Subtract the version $V_P$ from the amplitude envelope to obtain an update to the amplitude envelope.

The subtraction may eliminate one or more false peaks in the amplitude envelope.

Steps (a), (b) and (c) may be repeated a number of times. For example, each cycle of steps (a), (b) and (c) may eliminate the peak of highest amplitude remaining in the amplitude envelope. The procedure may terminate when the peak of highest amplitude is below a threshold value (e.g., a noise floor value).

Any of the various method embodiments disclosed herein (or any combinations thereof or portions thereof) may be implemented in terms of program instructions. The program instructions may be stored in (or on) any of various memory media. For example, in one embodiment, a memory medium may be configured to store program instructions, where the program instructions are executable to implement the method embodiment of FIG. 15A.

Furthermore, various embodiments of a system including a memory and a processor are contemplated, where the memory is configured to store program instructions and the processor is configured to read and execute the program instructions from the memory. In various embodiments, the program instructions encode corresponding ones of the method embodiments described herein (or combinations thereof or portions thereof). For example, in one embodiment, the program instructions are configured to implement the method of FIG. 15A. The system may also include the array of microphones (e.g., a circular array of microphones). For example, an embodiment of the system targeted for realization as a speakerphone may include the array of microphones. See for example FIGS. 1 and 7 and the corresponding descriptive passages herein.

Figure 16:
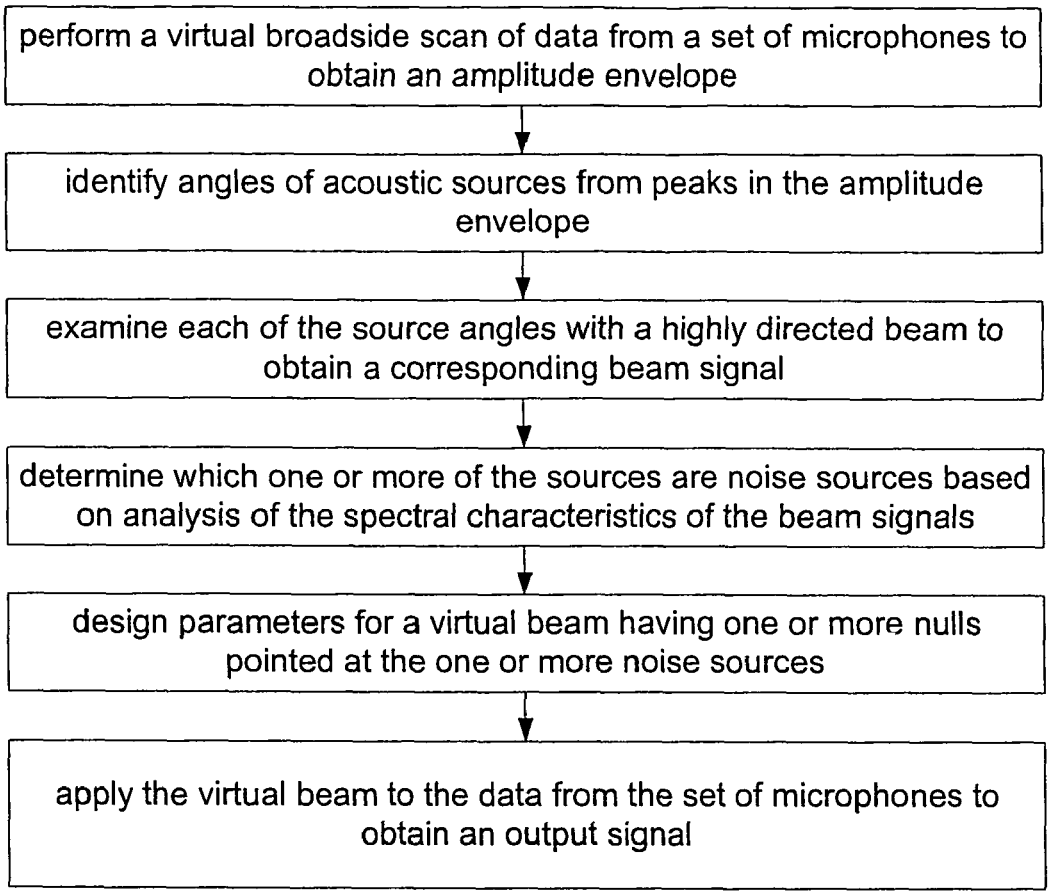
FIG. 16 illustrates one embodiment of a method for nulling out noise sources in the environment.

Chebyshev Constraint-Based Beam Forming and Null Placement to Tune Out Noise Sources In one set of embodiments, the processor 207 may be programmed to design one or more beams which have nulls in the directions of the noise sources and which are highly sensitive in the directions of the talkers, e.g., as illustrated in FIG. 16.

Part of the analysis described above is the identification of the angles at which noise sources occur. The processor 207 may identify the angle(s) of one or more of the noise sources having the highest amplitudes (in the amplitude envelope) among all the noise sources.

In real time, the processor 207 may design a hybrid beam (e.g., a superdirective/delay-and-sum beam as described above) pointed at a talker with one or more nulls pointed at the one or more loudest noise sources. The delay-and-sum portion of the beam may be designed using the well-known Chebyshev solution to the design constraints. The design constraints include the angle over which a relatively uniform response is desired and the desired rejection of the signals outside of the beam. Another constraint is that this solution is also constrained to be maximally flat over all of the frequencies of interest. Another constraint can be that we may want to point one or more sharp nulls at a particular angle that happens to be in the middle of the main lobe. For example, you can effectively "tune out" a projector that is quite near to the current talker's position.

Environment Modeling for Network Management

Figure 17A:
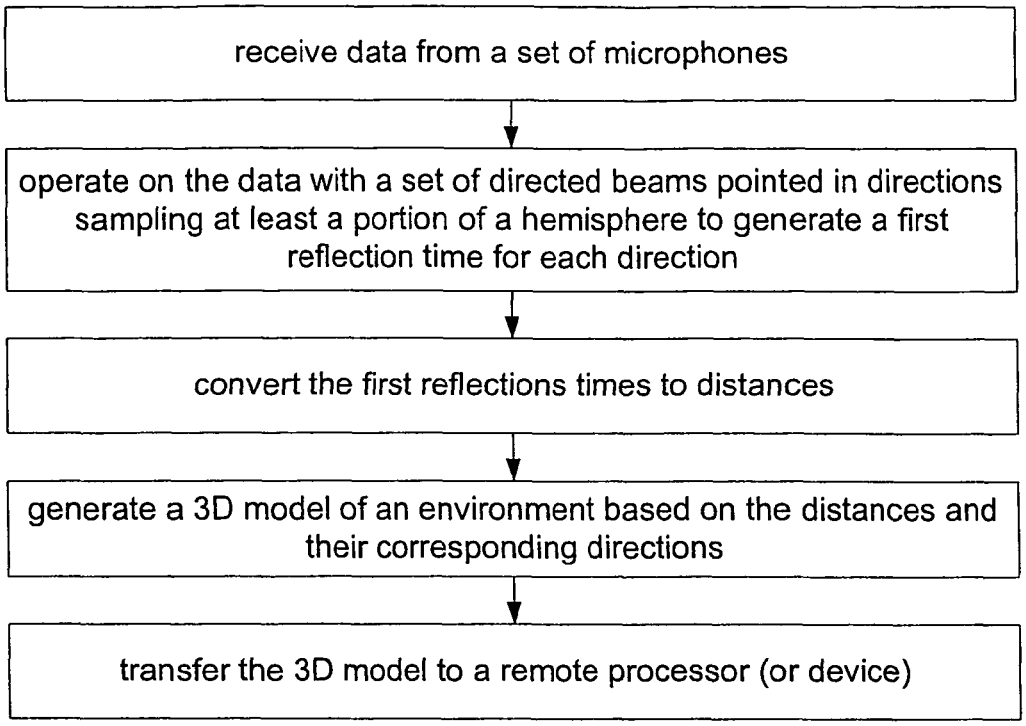
FIGS. 17A and 17B illustrates embodiments of methods for generating and exploiting 3D models of a room environment.

In some embodiments, the processor 207 may obtain a 3D model of the room environment by scanning a superdirected beam in all directions of the hemisphere and measure reflection time for each direction, e.g., as illustrated in FIG. 17A. The processor may transmit the 3D model to a central station for management and control.

The processor 207 may transmit a test signal and capture the response to the test signal from each of the input channels. The captured signals may be stored in memory.

Based on the known geometry of the microphone array (e.g., circular array), the processor is able to generate a highly directed beam in any direction of the hemisphere above the horizontal plane defined by the top surface of the speakerphone.

The processor may generate directed beams pointed in a set of directions that sample the hemisphere, e.g., in a fairly uniform fashion. For each direction, the processor applies the corresponding directed beam to the stored data (captured in response to the test signal transmission) to generate a corresponding beam signal.

For each direction, the processor may perform cross correlations between the beam signal and the test signal to determine the time of first reflection in each direction. The processor may convert the time of first reflection into a distance to the nearest acoustically reflective surface. These distances (in the various directions) may be used to build a 3D model of the spatial environment (e.g., the room) of the speakerphone. For example, in one embodiment, the model includes a set of vertices expressed in 3D Cartesian coordinates. Other coordinate system are contemplated as well.

It is noted that all the directed beams may operate on the single set of data gathered and stored in response to a single test signal transmission. The test signal transmission need not be repeated for each direction.

The beam forming and data analysis to generate the 3D model may be performed offline.

The processor may transfer the 3D model through a network to a central station. Software at the central station may maintain a collection of such 3D models generated by speakerphones distributed through the network.

Figure 17B:
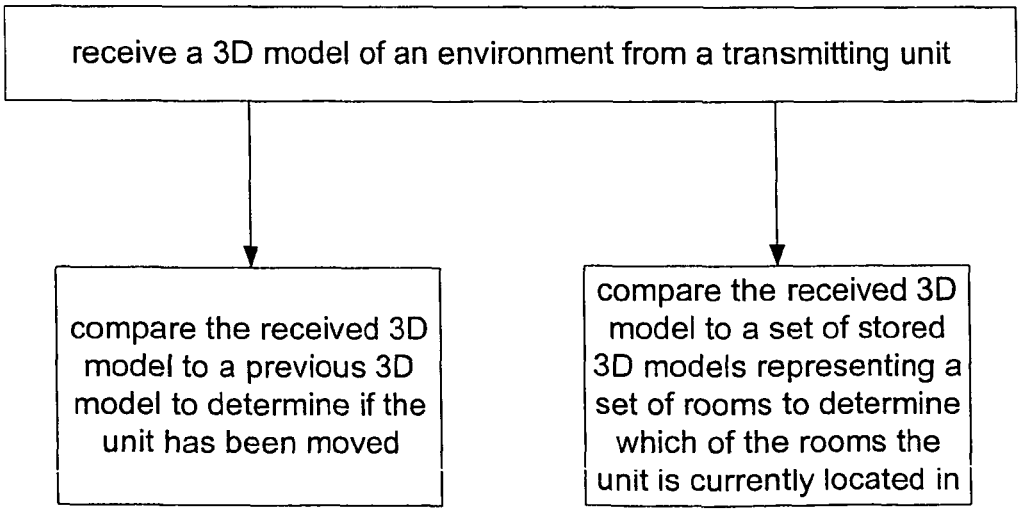

The speakerphone may repeatedly scan the environment as described above and send the 3D model to the central station. The central station can detect if the speakerphone has been displaced, or, moved to another room, by comparing the previous 3D model stored for the speakerphone to the current 3D model, e.g., as illustrated in FIG. 17B. The central station may also detect which room the speakerphone has been moved to by searching a database of room models. The room model which most closely matches the current 3D model (sent by the speakerphone) indicates which room the speakerphone has been moved to. This allows a manager or administrator to more effectively locate and maintain control on the use of the speakerphones.

By using the above methodology, the speakerphone can characterize an arbitrary shaped room, at least that portion of the room that is above the table (or surface on which the speakerphone is sitting). The 3D environment modeling may be done when there are no conversations going on and when the ambient noise is sufficiently low, e.g., in the middle of the night after the cleaning crew has left and the air conditioner has shut off.

Distance Estimation and Proximity Effect Compensation

Figure 18:
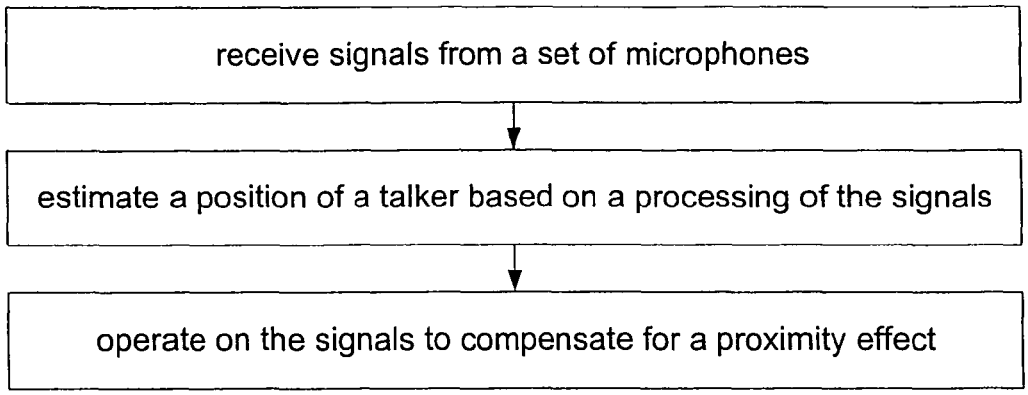
FIG. 18 illustrates one embodiment of a method for compensating for the proximity effect.

In one set of embodiments, the speakerphone may be programmed to estimate the position of the talker (relative to the microphone array), and then, to compensate for the proximity effect on the talker's voice signal using the estimated position, e.g., as illustrated in FIG. 18.

The processor 207 may receive a block of samples from each input channel. Each microphone of the microphone array has a different distance to the talker, and thus, the voice signal emitted by the talker may appear with different time delays (and amplitudes) in the different input blocks.

The processor may perform cross correlations to estimate the time delay of the talker's voice signal in each input block.

The processor may compute the talker's position using the set of time delays.

The processor may then apply known techniques to compensate for proximity effect using the known position of talker. This well-known proximity effect is due to the variation in the near-field boundary over frequency and can make a talker who is close to a directional microphone have much more low-frequency boost than one that is farther away from the same directional microphone.

Dereverberation of Talker's Signal using Environment Modeling.

Figure 19:
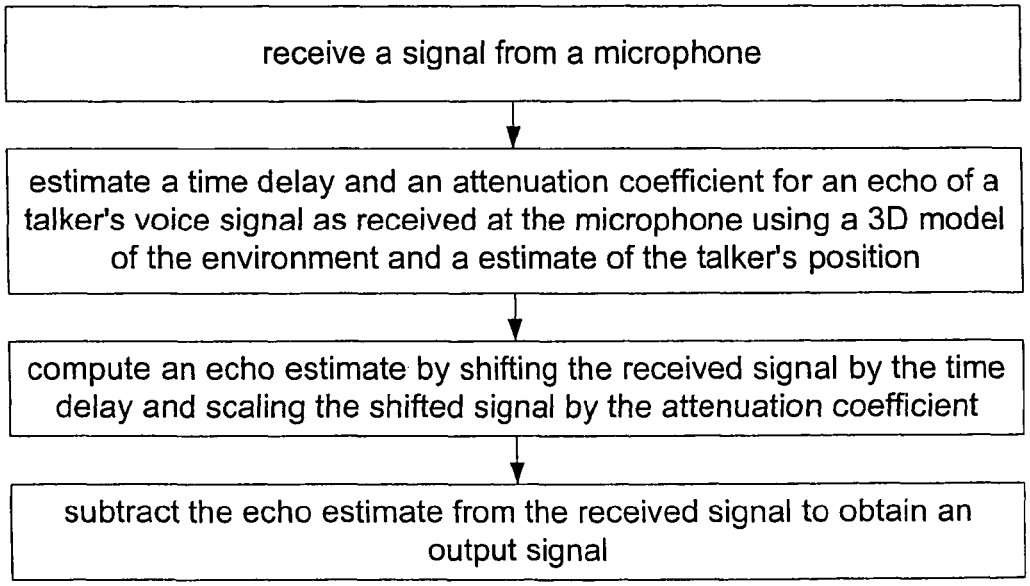
FIG. 19 illustrates one embodiment of a method for performing dereverberation.

In some embodiments, the speakerphone may be programmed to cancel echoes (of the talker's voice signal) from received input signals using knowledge of the talker's position and the 3D model of the room, e.g., as illustrated in FIG. 19.

If the talker emits a voice signal s(t), delayed and attenuated versions of the voice signal s(t) are picked up by each of the microphones of the array. Each microphone receives a direct path transmission from the talker and a number of reflected path transmissions (echoes). Each version has the form $c*s(t-\tau)$, where delay $\tau$ depends on the length of the transmission path between the talker and the microphone, and attenuation coefficient c depends on reflection coefficient of each reflective surface encountered (if any) in the transmission path.

The processor 207 may receive an input data block from each input channel. (Each input channel corresponds to one of the microphones.)

The processor may operate on the input data blocks as described above to estimate position of the talker.

The processor may use the talker position and the 3D model of the environment to estimate the delay times $\tau_{ij}$ and attenuation coefficients $c_{ij}$ for each microphone $M_i$ and each one of one or more echoes $E_j$ of the talker's voice signal as received at microphone $M_i$.

For each input channel signal $X_i$, i=1, 2, . . . , $N_M$, where $N_M$ is the number of microphones:

For each echo $E_j$ of the one or more echoes:

Generate an echo estimate signal $S_{ij}$ by (a) delaying the input channel signal $X_i$ by the corresponding echo delay time $\tau_{ij}$ and (b) multiplying the delayed signal by the corresponding attenuation coefficient $c_{ij}$;

Subtract a sum of the echo estimate signals (i.e., a sum over index j) from the received signal $X_i$ to generate an output signal $Y_i$.

The output signals $Y_i$, i=1, 2, . . . , $N_M$, may be combined into a final output signal. The final output signal may be transmitted to a remote speakerphone. Alternatively, the output signals may be operated on to achieve further enhancement of signal quality before formation of a final output signal.

Encoding and Decoding

A described variously above, the speakerphone 200 is configured to communicate with other devices, e.g., speakerphones, video conferencing systems, computers, etc. In particular, the speakerphone 200 may send and receive audio data in encoded form. Thus, the speakerphone 200 may employ an audio codec for encoding audio data streams and decoding already encoded streams.

Figure 20A:
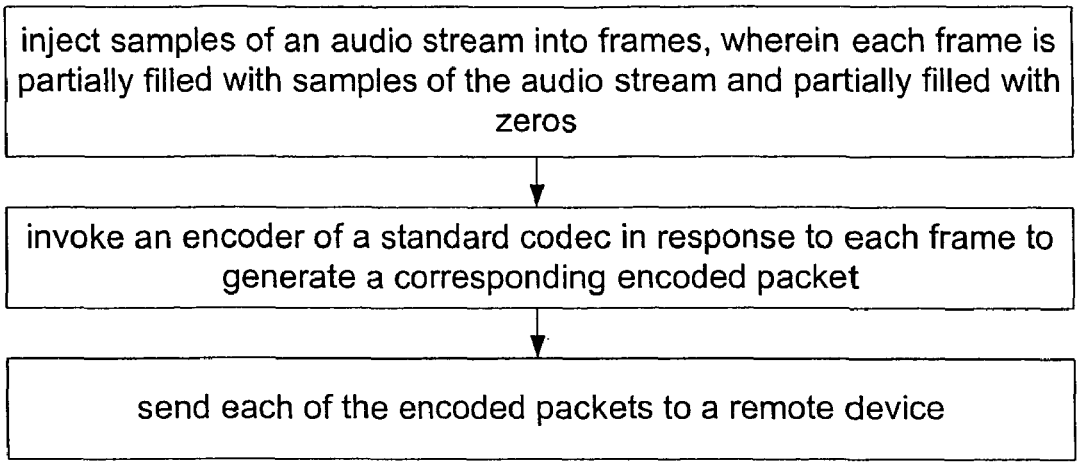
FIGS. 20A and 20B illustrate embodiments of methods for send and receiving data using an audio codec.
Figure 20B:
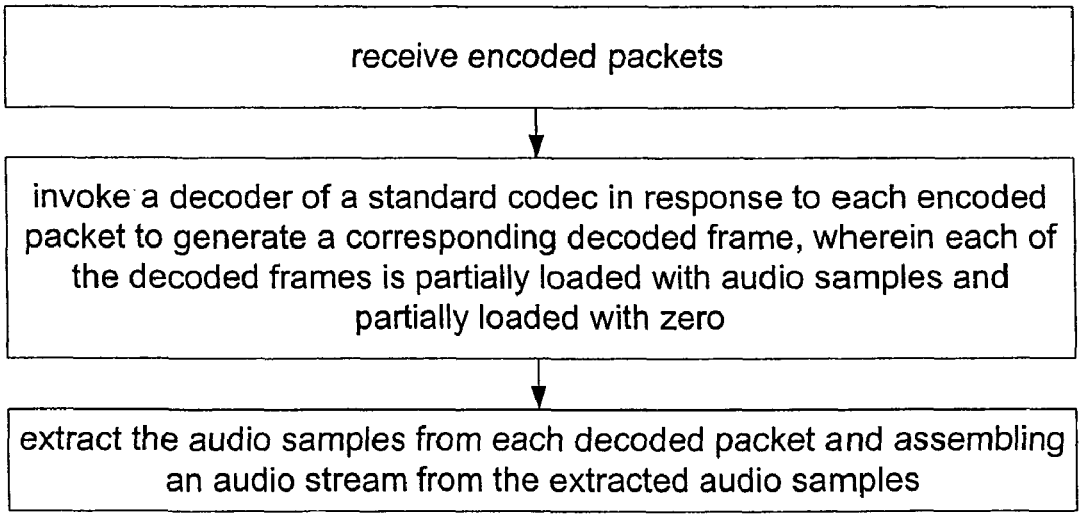

In one set of embodiments, the processor 207 may employ a standard audio codec, especially a high quality audio codec, in a novel and non-standard way as described below and illustrated in FIGS. 20A and 20B. For the sake of discussion, assume that the standard codec is designed to operate on frames, each having a length of $N_{FR}$ samples.

The processor 207 may receive a stream S of audio samples that is to be encoded.

The processor may feed the samples of the stream S into frames. However, each frame is loaded with $N_A$ samples of the stream S, where $N_A$ is less than $N_{FR}$, and the remaining $N_{FR}$-$N_A$ sample locations of the frame are loaded with zeros.

There are a wide variety of options for where to place the zeroes within the frame. For example, the zeros may be placed at the end of the frame. As another example, the zeros may be placed at the beginning of the frame. As yet another example, some of the zeros may be placed at the beginning of the frame and the remainder may be placed at the end of the frame.

The processor may invoke the encoder of the standard codec for each frame. The encoder operates on each frame to generate a corresponding encoded packet. The processor may send the encoded packets to the remote device.

A second processor at the remote device receives the encoded packets transmitted by the first processor. The second processor invokes a decoder of the standard codec for each encoded packet. The decoder operates on each encoded packet to generate a corresponding decoded frame.

The second processor extracts the $N_A$ audio samples from each decoded frame and assembles the audio samples extracted from each frame into an audio stream R. The zeros are discarded.

Interchange the roles of the first processor and second processor in the above discussion and one has a description of transmission in the reverse direction. Thus, the software available to each processor may include the encoder and the decoder of a standard codec. Each processor may generate frames only partially loaded audio samples from an audio stream and partially loaded with zeros. Each processor may extract audio samples from decoded frames to reconstruct an audio stream.

Because the first processor is injecting only $N_A$ samples (and not $N_{FR}$ samples) of the stream S into each frame, the first processor may generate the frames (and invoke the encoder) a rate higher than the rate specified by the codec standard. Similarly, the second processor may invoke the decoder at the higher rate. Assuming the sampling rate of the stream S is $r_s$, the first processor (second processor) may invoke the encoder (decoder) at a rate of one frame (packet) every $N_A/r_s$ seconds. Thus, audio data may delivered to remote device with significantly lower latency than if each frame were filled with $N_{FR}$ samples of the audio stream S.

In one group of embodiments, the standard codec employed by the first processor and second processor may be a low complexity (LC) version of the Advanced Audio Codec (AAC). The AAC-LC specifies a frame size $N_{FR}$=1024. In some embodiments of this group, the value $N_A$ may be any value in the closed interval [160,960]. In other embodiments of this group, the value $N_A$ may be any value in the closed interval [320,960]. In yet other embodiments of this group, the value $N_A$ may be any value in the closed interval [480, 800].

In a second group of embodiments, the standard codec employed by the first processor and the second processor may be a low delay (LD) version of the AAC. The AAC-LD specifies a frame size of $N_{FR}$=512. In some embodiments of this group, the value $N_A$ may be any value in the closed interval [80,480]. In other embodiments of this group, the value $N_A$ may be any value in the closed interval [160,480]. In yet other embodiments of this group, the value $N_A$ may be any value in the closed interval [256,384].

In a third group of embodiments, the standard codec employed by the first processor and the second processor may be a 722.1 codec.

Microphone/Speaker Calibration Processes

A stimulus signal may be transmitted by the speaker. The returned signal (i.e., the signal sensed by the microphone array) may be used to perform calibration. This returned signal may include four basic signal categories (arranged in order of decreasing signal strength as seen by the microphone):

1) internal audio
   a: structure-borne vibration and/or radiated audio
   b: structure-generated audio (i.e., buzzes and rattles)
2) first arrival (i.e., direct air-path) radiated audio
3) room-related audio
   a: reflections
   b: resonances
4) measurement noise
   a: microphone self-noise
   b: external room noise Each of these four categories can be further broken down into separate constituents. In some embodiments, the second category is measured in order to determine the microphone calibration (and microphone changes).

Measuring Internal Audio

In one set of embodiment, one may start by measuring the first type of response at the factory in a calibration chamber (where audio signals of type 3 or 4 do not exist) and subtracting that response from subsequent measurements. By comparison with a "golden unit", one knows how audio of type 1 a) should measure, and one can then measure microphone self-noise (type 4 b) by recording data in a silent test chamber, so one can separate the different responses listed above by making a small set of simple measurements in the factory calibration chamber.

It is noted that a "failure" caused by 1 b) may dominate the measurements. Furthermore, "failures" caused by 1 b) may change dramatically over time, if something happens to the physical structure (e.g., if someone drops the unit or if it is damaged in shipping or if it is not well-assembled and something in the internal structure shifts as a result of normal handling and/or operation).

Fortunately, in a well-put together unit, the buzzes and rattles are usually only excited by a limited band of frequencies (e.g., those where the structure has a natural set of resonances). One can previously determine these "dangerous frequencies" by experiment and by measuring the "golden unit(s)". One removes these signals from the stimulus before making the measurement by means of a very sharp notch in the frequency response of signals that are transmitted to the speaker amp.

In one embodiment, these frequencies may be determined by running a small amplitude swept-sine stimulus through the unit's speaker and measure the harmonic distortion of the resulting raw signal that shows up in the microphones. In the calibration chamber, one can measure the distortion of the speaker itself (using an external reference microphone) so one can know even the smallest levels of distortion caused by the speaker as a reference. If the swept sine is kept small enough, then one knows a-priori that the loudspeaker should not typically be the major contributor to the distortion.

If the calibration procedure is repeated in the field, and if there is distortion showing up at the microphones, and if it is equal over all of the microphones, then one knows that the loudspeaker has been damaged. If the microphone signals show non-equal distortion, then one may be confident that it is something else (typically an internal mechanical problem) that is causing this distortion. Since the speaker may be the only internal element which is equidistant from all microphones, one can determine if there is something else mechanical that is causing the distortions by examining the relative level (and phase delay, in some cases) of the distortion components that show up in each of the raw microphone signals.

So, one can analyze the distortion versus frequency for all of the microphones separately and determine where the buzzing and/or rattling component is located and then use this information to make manufacturing improvements. For example, one can determine, through analysis of the raw data, whether a plastic piece that is located between microphones 3 and 4 is not properly glued in before the unit leaves the factory floor. As another example, one can also determine if a screw is coming loose over time. Due to the differences in the measured distortion and/or frequency response seen at each of the mics, one can also determine the difference between one of the above failures and one that is caused by a mic wire that has come loose from its captive mounting, since the anomalies caused by that problem have a very different characteristic than the others.

Measurement Noise

One can determine the baseline microphone self-noise in a factory calibration chamber. In the field, however, it may be difficult to separate out the measurement of the microphone's self-noise and the room noise unless one does a lot of averaging. Even then, if the room noise is constant (in amplitude), one cannot completely remove it from the measurement. However, one can wait for the point where the overall noise level is at a minimum (for example if the unit wakes up at 2:30 am and "listens" to see if there is anyone in the room or if the HVAC fan is on, etc.) and then minimize the amount of room noise that one will see in the overall microphone self noise measurement.

Another strategy is if the room has anisotropic noise (i.e., if the noise in the room has some directional characteristic). Then one can perform beam-forming on the mic array, find the direction that the noise is strongest, measure its amplitude and then measure the noise sound field (i.e., its spatial characteristic) and then use that to come up with an estimate of how large a contribution that the noise field will make at each microphone's location. One then subtracts that value from the measured microphone noise level in order to separate the room noise from the self-noise of the mic itself.

Room-Related Audio Measurement

There are two components of the signal seen at each mic that are due to the interactions of the speaker stimulus signal and the room in which the speaker is located: reflections and resonances. One can use the mic array to determine the approximate dimensions of the room by sending a stimulus out of the loudspeaker and then measuring the first time of reflection from all directions. That will effectively tell one where the walls and ceiling are in relation to the speakerphone. From this information, one can effectively remove the contribution of the reflections to the calibration procedure by "gating" the data acquisition from the measured data sets from each of the mics. This gating process means that one only looks at the measured data during specific time intervals (when one knows that there has not been enough time for a reflection to have occurred).

The second form of room related audio measurement may be factored in as well. Room-geometry related resonances are peaks and nulls in the frequency response as measured at the microphone caused by positive and negative interference of audio waveforms due to physical objects in the room and due to the room dimensions themselves. Since one is gating the measurement based on the room dimensions, then one can get rid of the latter of the two (so-called standing waves). However, one may still need to factor out the resonances that are caused by objects in the room that are closer to the phone than the walls (for example, if the phone is sitting on a wooden table that resonates at certain frequencies). One can deal with these issues much in the same way that one deals with the problematic frequencies in the structure of the phone itself; by adding sharp notches in the stimulus signal such that these resonances are not excited. The goal is to differentiate between these kinds of resonances and similar resonances that occur in the structure of the phone itself. Three methods for doing this are as follows: 1) one knows a-priori where these resonances typically occur in the phone itself, 2) external resonances tend to be lower in frequency than internal resonances and 3) one knows that these external object related resonances only occur after a certain time (i.e., if one measures the resonance effects at the earliest time of arrival of the stimulus signal, then it will be different than the resonance behavior after the signal has had time to reflect off of the external resonator).

So, after one factors in all of the adjustments described above, one then can isolate the first arrival (i.e., direct air-path) radiated audio signal from the rest of the contributions to the mic signal. That is how one can perform accurate offline (and potentially online) mic and speaker calibration.

CONCLUSION

Various embodiments may further include receiving, sending or storing program instructions and/or data implemented in accordance with any of the methods described herein (or combinations thereof or portions thereof) upon a computer-accessible medium. Generally speaking, a computer-accessible medium may include:

storage media or memory media such as magnetic media (e.g., magnetic disk), optical media (e.g., CD-ROM), semiconductor media (e.g., any of various kinds of RAM or ROM), or any combination thereof;

transmission media or signals such as electrical, electromagnetic, or digital signals, conveyed via a communication medium such as network and/or a wireless link.

The various methods as illustrated in the Figures and described herein represent exemplary embodiments of methods. The methods may be implemented in software, hardware, or a combination thereof. The order of operations in the various methods may be changed, and various operations may be added, reordered, combined, omitted, modified, etc.

Various modifications and changes may be made as would be obvious to a person skilled in the art having the benefit of this disclosure. It is intended that the invention embrace all such modifications and changes and, accordingly, the above description be regarded in an illustrative rather than a restrictive sense.

What is claimed is:

1. A method comprising:

(a) identifying angles of acoustic sources from peaks in an amplitude envelope, wherein the amplitude envelope corresponds to an output of a virtual broadside scan on blocks of input signal samples, one block from each microphone in an array of microphones, wherein the microphones of the array are arranged on a circle, wherein the virtual broadside scan comprises scanning a virtual broadside array through a set of angles spanning the circle in order to generate said output, wherein the virtual broadside array operates on the blocks of input signal samples;

(b) for each of the source angles, operating on the input signal blocks with a directed beam pointed in the direction of the source angle to obtain a corresponding beam signal, wherein each of the beam signals has a corresponding energy;

(c) classifying each of the sources as speech or noise based on analysis of spectral characteristics of the corresponding beam signal, wherein one or more of the sources are classified as speech;

(d) of those one or more sources that are classified as speech, identifying one or more sources whose corresponding beam signals have highest energies;

(e) generating an output signal from the one or more beam signals corresponding to the one or more speech sources having highest energies.

2. The method of claim 1 further comprising:

performing a virtual broadside scan on the blocks of input signal samples to generate the amplitude envelope.

3. The method of claim 2 further comprising:

repeating said performing and operations (a) through (e) on successive sets of input signal sample blocks from the array of microphones.

4. The method of claim 1 further comprising:

transmitting the output signal to one or more devices.

5. The method of claim 1, wherein the one or more speech sources having highest energies includes two or more simultaneous talkers.

6. The method of claim 1, wherein the microphones of said array are arranged in a plane.

7. The method of claim 1, wherein the microphones of said array are omni-directional microphones.

8. The method of claim 1, wherein said identifying one or more angles of one or more acoustic sources from peaks in an amplitude envelope comprises:

estimating an angular position of a first peak in the amplitude envelope;

constructing a shifted and scaled version of a virtual broadside response pattern using the angular position and an amplitude of the first peak;

subtracting the shifted and scaled version from the amplitude envelope to obtain an update to the amplitude envelope.

9. The method of claim 8 further comprising repeating said estimating, said constructing, and said subtracting on the updated amplitude envelope in order to identify a second peak.

10. A computer readable memory medium configured to store program instructions, wherein the program instructions are executable to implement:

(a) identifying angles of acoustic sources from peaks in an amplitude envelope, wherein the amplitude envelope corresponds to an output of a virtual broadside scan on blocks of input signal samples, one block from each microphone in an array of microphones, wherein the microphones of the array are arranged on a circle, wherein the virtual broadside scan comprises scanning a virtual broadside array through a set of angles spanning the circle in order to generate said output, wherein the virtual broadside array operates on the blocks of input signal samples;

(b) for each of the source angles, operating on the input signal blocks with a directed beam pointed in the direction of the source angle to obtain a corresponding beam signal, wherein each of the beam signals has a corresponding energy;

(c) classifying each of the sources as speech or noise based on analysis of spectral characteristics of the corresponding beam signal, wherein one or more of the sources are classified as speech;

(d) of those one or more sources that are classified as speech, identifying one or more sources whose corresponding beam signals have highest energies;

(e) generating an output signal from the one or more beam signals corresponding to the one or more speech sources having highest energies.

11. The memory medium of claim 10 wherein the program instructions are executable to further implement:

performing a virtual broadside scan on the blocks of input signal samples to generate the amplitude envelope.

12. The memory medium of claim 11 wherein the program instructions are executable to further implement:

repeating said performing and operations (a) through (e) on successive sets of input signal sample blocks from the array of microphones.

13. The memory medium of claim 10 wherein the program instructions are executable to further implement:

transmitting the output signal to one or more remote devices.

14. The memory medium of claim 10, wherein the one or more speech sources having highest energies includes two or more simultaneous talkers.

15. The memory medium of claim 10, wherein said identifying one or more angles of one or more acoustic sources from peaks in an amplitude envelope comprises:

estimating an angular position of a first peak in the amplitude envelope;

constructing a shifted and scaled version of a virtual broadside response pattern using the angular position and an amplitude of the first peak;

subtracting the shifted and scaled version from the amplitude envelope to obtain an update to the amplitude envelope.

16. The memory medium of claim 15 wherein the program instructions are executable to further implement:

repeating said estimating, said constructing and said subtracting on the updated amplitude envelope.

17. A system comprising:

memory configured to store program instructions;

a processor configured to read and execute the program instructions from the memory, wherein the program instructions are executable by the processor to implement:

(a) identifying angles of acoustic sources from peaks in an amplitude envelope, wherein the amplitude envelope corresponds to an output of a virtual broadside scan on blocks of input signal samples, one block from each microphone in an array of microphones, wherein the microphones of the array are arranged on a circle, wherein the virtual broadside scan comprises scanning a virtual broadside array through a set of angles spanning the circle in order to generate said output, wherein the virtual broadside array operates on the blocks of input signal samples;

(b) for each of the source angles, operating on the input signal blocks with a directed beam pointed in the direction of the source angle to obtain a corresponding beam signal, wherein each of the beam signals has a corresponding energy;

(c) classifying each of the sources as speech or noise based on analysis of spectral characteristics of the corresponding beam signal, wherein one or more of the sources are classified as speech;

(d) of those one or more sources that are classified as speech, identifying one or more sources whose corresponding beam signals have highest energies;

(e) generating an output signal from the one or more beam signals corresponding to the one or more speech sources having highest energies.

18. The system of claim 17 further comprising said array of microphones.

* * * * *